US008588663B2

(12) United States Patent
Suzuki et al.

(10) Patent No.: US 8,588,663 B2
(45) Date of Patent: Nov. 19, 2013

(54) DEVELOPING DEVICE HAVING A MAGNETIC MEMBER AND IMAGE FORMING APPARATUS INCLUDING DEVELOPING DEVICE

(75) Inventors: Shiro Suzuki, Kanagawa (JP); Yoshifumi Ozaki, Kanagawa (JP); Akihiko Noda, Kanagawa (JP); Atsuyuki Kitamura, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 237 days.

(21) Appl. No.: 13/036,494

(22) Filed: Feb. 28, 2011

(65) Prior Publication Data

US 2012/0076540 A1 Mar. 29, 2012

(30) Foreign Application Priority Data

Sep. 28, 2010 (JP) ..... 2010-217871

(51) Int. Cl.
*G03G 15/08* (2006.01)

(52) U.S. Cl.
USPC ..... 399/274

(58) Field of Classification Search
USPC ..... 399/53, 267, 274, 275, 284
See application file for complete search history.

(56) References Cited

U.S. PATENT DOCUMENTS 4,487,496 A * 12/1984 Baier et al. ..... 399/274
4,624,559 A * 11/1986 Haneda et al. ..... 399/236
5,517,286 A * 5/1996 Tada et al. ..... 399/274
5,682,585 A 10/1997 Yamaguchi et al.
6,711,372 B1 * 3/2004 Noda et al. ..... 399/286
6,775,506 B2 * 8/2004 Endoh et al. ..... 399/284
7,514,196 B2 * 4/2009 Nagai ..... 430/119.82
2011/0229216 A1 * 9/2011 Iwamura ..... 399/274

FOREIGN PATENT DOCUMENTS

JP A-3-118575 5/1991
JP A-5-19631 1/1993
JP 05241436 A * 9/1993
JP A-7-181806 7/1995
JP 09090747 A * 4/1997
JP A-11-249424 9/1999
JP 2002333769 A * 11/2002
JP 2004151350 A * 5/2004

* cited by examiner

*Primary Examiner* — Robert Beatty
(74) *Attorney, Agent, or Firm* — Oliff & Berridge, PLC

(57) ABSTRACT

A developing device includes: a developer holding body including: a hollow development rotary body which is opposed to an image holding body capable of holding a toner image and has a smooth surface whose surface roughness is lower than or equal to 5 μm in terms of maximum height; and a magnet member which is fixedly housed in the development rotary body and in which a plurality of magnetic poles are arranged alongside its periphery, the developer holding body operating in such a manner that developer containing toner and carrier is held on the development rotary body by magnetic force produced by the magnetic poles of the magnet member as the development rotary body is rotated; a layer regulating rotary body as defined herein; and a development driving device as defined herein.

10 Claims, 21 Drawing Sheets

Vr : Vmin≦Vr≦Vmax
Vd : Vd=const.

MOS CONTROL USING IMAGE INFORMATION (LOW IMAGE DENSITY/HIGH IMAGE DENSITY)

MOS CONTROL USING USE HISTORY INFORMATION (NUMBER OF PRINTS)

MOS CONTROL USING ENVIRONMENT INFORMATION (TEMPERATURE AND HUMIDITY)

NON-DEVELOPMENT

Y-COLOR DEVELOPING STATE

COMPLETION OF Y-COLOR DEVELOPMENT

M-COLOR DEVELOPMENT

COMPLETION OF M-COLOR DEVELOPMENT

C-COLOR DEVELOPMENT

COMPLETION OF C-COLOR DEVELOPMENT

K-COLOR DEVELOPMENT

COMPLETION OF K-COLOR DEVELOPMENT

Y-COLOR DEVELOPMENT

COMPLETION OF Y-COLOR DEVELOPMENT

SWITCHING TO M-COLOR DEVELOPING DEVICE

M-COLOR DEVELOPMENT

COMPLETION OF M-COLOR DEVELOPMENT

SWITCHING TO C-COLOR DEVELOPING DEVICE

C-COLOR DEVELOPMENT

COMPLETION OF C-COLOR DEVELOPMENT

SWITCHING TO K-COLOR DEVELOPING DEVICE

K-COLOR DEVELOPMENT

COMPLETION OF K-COLOR DEVELOPMENT

SWITCHING TO Y-COLOR DEVELOPING DEVICE

EXAMPLE

COMPARATIVE EXAMPLES

FIG. 20

| TRIMMER | MAGNETIC FLUX DENSITY OF LAYER REGULATING MAGNETIC POLE | DEVELOPING SLEEVE SURFACE | | |
|---|---|---|---|---|
| | | BLASTED | GROOVED | SMOOTH |
| FIXED TRIMMER | 80 mT | ○ MOS IS CONSTANT | ○ MOS IS CONSTANT | × LAYER CANNOT BE FORMED |
| | 50 mT | ○ MOS IS CONSTANT | ○ MOS IS CONSTANT | × LAYER CANNOT BE FORMED |
| ROTARY TRIMMER | 80 mT | △× MOS IS TOO LARGE | △× MOS IS TOO LARGE | △ MOS IS TOO LARGE |
| | 50 mT | △× MOS IS TOO LARGE | △× MOS IS TOO LARGE | ◎ MOS IS VARIABLE |

DEVELOPING DEVICE HAVING A MAGNETIC MEMBER AND IMAGE FORMING APPARATUS INCLUDING DEVELOPING DEVICE

CROSS-REFERENCE TO RELATED APPLICATIONS

This application is based on and claims priority under 35 USC 119 from Japanese Patent Application No. 2010-217871 filed on Sep. 28, 2010.

BACKGROUND

Technical Field

The present invention relates to a developing device and an image forming apparatus including it.

SUMMARY

According to an aspect of the invention, there is provided a developing device including:

a developer holding body including:

a hollow development rotary body which is opposed to an image holding body capable of holding a toner image and has a smooth surface whose surface roughness is lower than or equal to 5 μm in terms of maximum height; and a magnet member which is fixedly housed in the development rotary body and in which plural magnetic poles are arranged alongside its periphery, the developer holding body operating in such a manner that developer containing toner and carrier is held on the development rotary body by magnetic force produced by the magnetic poles of the magnet member as the development rotary body is rotated;

a layer regulating rotary body which is opposed to the development rotary body with a non-contact gap formed between them so as to regulate the thickness of a developer layer held on the developer holding body, a portion, facing the development rotary body, of the layer regulating rotary body being able to move at least in the same direction as a corresponding portion of the development rotary body; and a development driving device for rotationally driving the development rotary body of the developer holding body and the layer regulating rotary body and variably adjusting the circumferential speed of the layer regulating rotary body according to an increase or decrease in the thickness, to be regulated, of a developer layer held on the developer holding body, during a development operation.

BRIEF DESCRIPTION OF THE DRAWINGS

Exemplary embodiments of the present invention will be described in detail based on the following figures, wherein:

FIGS. 14A, 14B and 140 are a first set of diagrams showing how developing devices of respective color components operate when switching is made from a full-color mode to a monochrome (black) mode in an image forming apparatus according to a third exemplary embodiment which employs a tandem image forming method and has plural photoreceptor bodies;

FIG. 20 is a table showing MOS values that are obtained by various combinations of a trimmer, a magnetic flux density of a layer regulating magnetic pole, and a developing sleeve surface type to evaluate developer conveying characteristics of the developing devices according to Example and Comparative Examples 1 and 2.

DESCRIPTION OF SYMBOLS

1 . . . Image holding body; 2 . . . Developer holding body; 3 . . . Development rotary body; 3*a* . . . Smooth surface; 4 . . . Magnet member; 5 . . . Magnetic poles; 5*a* . . . Layer regulating magnetic pole; 6 . . . Layer regulating rotary body; 7 . . . Stirring and transporting member; 8 . . . Development container; 9 . . . Latent image forming device; 10 . . . Developing device; 11 . . . Development driving device; 12 . . . Calculating section; 13 . . . Circumferential speed determining section; A . . . Development position; B . . . Layer regulating position; G . . . Developer; $v_d$ . . . Circumferential speed of development rotary body; $v_r$ . . . Circumferential speed of layer regulating rotary body.

DETAILED DESCRIPTION

General Exemplary Embodiment

Figure 1:
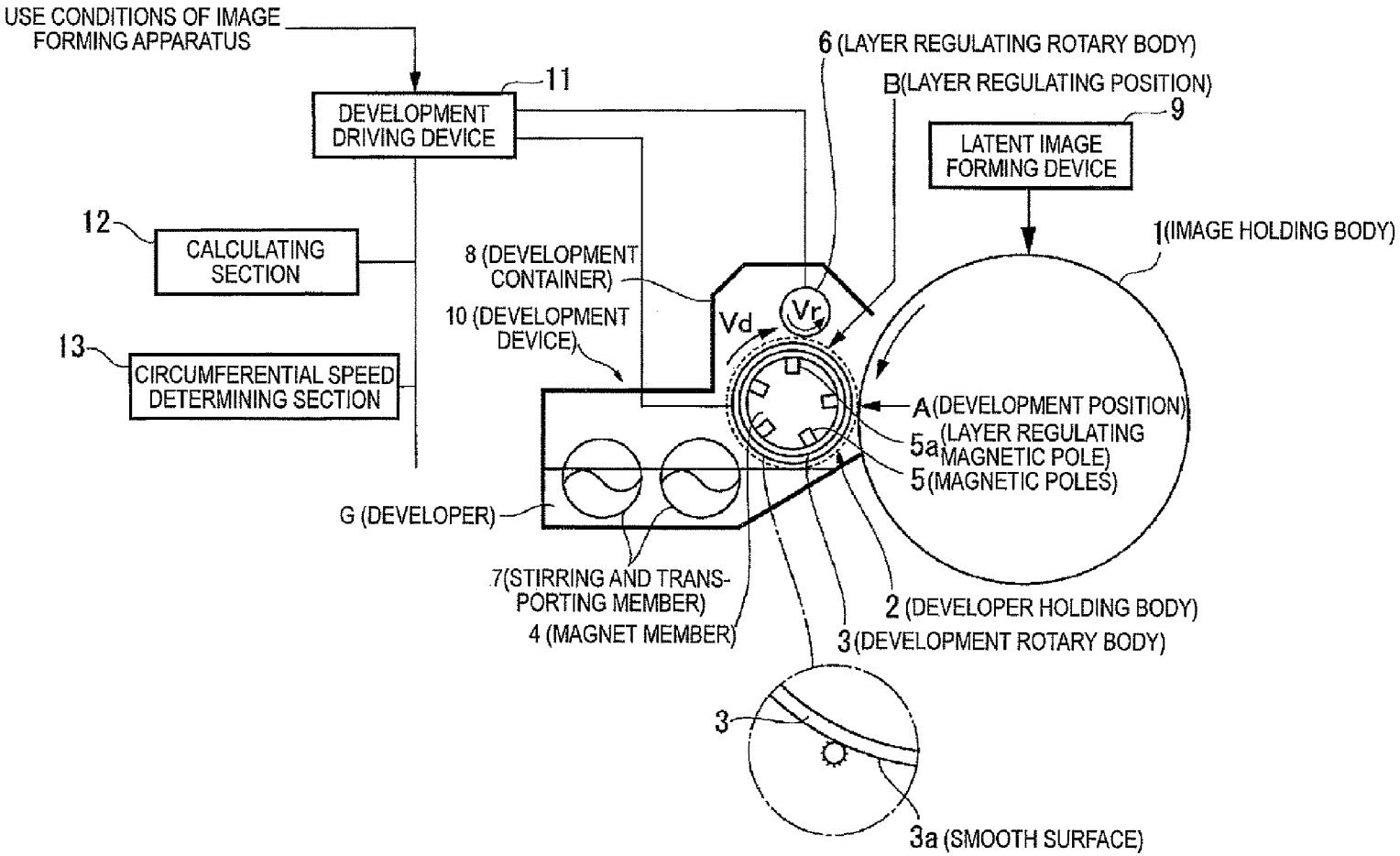
FIG. 1 illustrates an image forming apparatus according to a general exemplary embodiment of the present invention.

FIG. 1 illustrates an image forming apparatus according to a general exemplary embodiment of the present invention.

As shown in FIG. 1, the image forming apparatus is equipped with an image holding body 1 capable of holding a toner image, a latent image forming device 9 for forming a latent image on the image holding body 1, and a developing device 10 for developing the latent image formed on the image holding body 1 with toner.

In particular, in the general exemplary embodiment, the developing device 10 is equipped with a developer holding body 2, a layer regulating rotary body 6, and a development driving device 11. The developer holding body 2 has a development rotary body 3 and a magnet member 4. The development rotary body 3 is hollow, is opposed to the image holding body 1, and has a smooth surface 3*a* whose surface roughness is lower than or equal to 5 μm in terms of maximum height. The magnet member 4 is fixedly housed in the development rotary body 3, and plural magnetic poles 5 are arranged alongside the periphery of the magnet member 4. As the development rotary body 3 is rotated, developer G containing toner and carrier is held on the development rotary body 3 by magnetic force produced by the magnetic poles 5 of the magnet member 4. The layer regulating rotary body 6 is opposed to the development rotary body 3 with a non-contact gap TG (see FIG. 2A) formed between them so as to regulate the thickness of a developer layer held on the developer holding body 2. And a portion, facing the development rotary body 3, of the layer regulating rotary body 6 can move at least in the same direction as a corresponding portion of the development rotary body 3. During a development operation, the development driving device 11 rotationally drives the development rotary body 3 of the developer holding body 2 and the layer regulating rotary body 6 and variably adjusts (increases or decreases) the circumferential speed $v_r$ of the layer regulating rotary body 6 according to an increase or decrease in the thickness, to be regulated, of a developer layer held on the developer holding body 2.

In FIG. 1, reference numeral 7 denotes stirring and transporting members which transport (circulate) developer G (containing toner and carrier) in a development container 8 while stirring it and causes the developer holding body 2 to hold developer G after the toner has been charged sufficiently.

In the above image forming apparatus, the image holding body 1 may have any of various forms as appropriate as long as an electrostatic latent image can be formed thereon and it can hold a toner image. For example, the image holding body 1 may be a photoreceptor body or a dielectric body or may be in such a form that pixel electrodes to which latent image voltages corresponding to an electrostatic latent image are to be applied are arranged in matrix form on the surface of a holding body which circulates.

The latent image forming device 9 may be any of various types as appropriate as long as it can form an electrostatic latent image on the image holding body 1. Where the image holding body 1 is a photoreceptor body or a dielectric body, the latent image forming device 9 may be composed of a charging device and a latent image writing device using light, ions, or the like. Where the image holding body 1 is of such a type as to have pixel electrodes, the latent image forming device 9 may be such as to apply latent image voltages corresponding to an electrostatic latent image to the pixel electrodes.

It suffices that the developing device 10 have the developer holding body 2 for holding and conveying developer. The developer holding body 2 is required to be provided with the development rotary body 3 having the smooth surface 3*a* and the magnet member 4 which is housed in the development rotary body 3.

In this general exemplary embodiment, the development rotary body 3 may be either a rigid cylindrical body or a flexible thin-film member. The surface roughness of the smooth surface 3*a* is required to be lower than or equal to 5 μm in terms of maximum height Rz (corresponds to the JIS B0601 2001 standard). The development rotary body 3 is rotated at a preset circumferential speed $v_d$. However, there is another mode in which its circumferential speed is set variably depending on process conditions (e.g., the circumferential speed is set low when a thick sheet (recording medium) is being conveyed).

The magnetic poles 5 are arranged in the magnet member 4. The magnetic poles 5 include conveying magnetic poles for conveying developer, a development magnetic pole disposed adjacent to a development position A so as to face the image holding body 1, a layer regulating magnetic pole 5*a* disposed adjacent to a layer regulating position B so as to face the layer regulating rotary body 6, an absorption magnetic pole for absorbing and holding developer G at a development and absorption position on the development rotary body 3, and a peeling magnetic pole for peeling developer at a developer peeling position on the development rotary body 3. Each of the magnetic poles 5 does not perform only one function; the magnetic poles 5 are arranged so that each one performs plural functions.

It suffices that the layer regulating rotary body 6 be such that its portion facing the development rotary body 3 is moved at least in the same direction as a corresponding portion of the development rotary body 3, and that a predetermined gap TG (see FIG. 2A) is secured between itself and the development rotary body 3 in such a range that at least the thickness of a developer layer can be regulated. The layer regulating rotary body 6 may be made of either a magnetic material or a non-magnetic material. No particular limitations are imposed on its surface roughness. However, if it is too rough, the thickness of a developer layer may vary too much when the circumferential speed $v_r$ of the layer regulating rotary body 6 is varied, because the surface roughness greatly contributes to conveying force to act on developer G.

It suffices that the development driving device 11 be of such a type as to rotationally drive the development rotary body 3 of the developer holding body 2 and the layer regulating rotary body 6. It is preferable that the development driving device 11 stop rotational driving on the development rotary body 3 when it is not necessary. On the other hand, the development driving device 11 such as to increase or decrease the circumferential speed $v_r$ of the layer regulating rotary body 6 in a predetermined range according to an increase or decrease in the thickness of a developer layer to be regulated.

Next, typical or preferable modes of the general exemplary embodiment will be described.

First, whereas the magnetic force distribution of the magnetic poles 5 of the magnet member 4 may be set as appropriate, it is preferable that the magnet member 4 of the developer holding body 2 have the layer restricting magnetic pole 5*a* which produces a magnetic flux density of 30 to 60 mT in a region where the layer regulating rotary body 6 and the development rotary body 3 are closest to each other.

That is, the magnetic flux density that is produced by the layer restricting magnetic pole 5*a* in the region where the layer regulating rotary body 6 and the development rotary body 3 are closest to each other is set in a preferable range of 30 to 60 mT. If the magnetic flux density is lower than 30 mT, the degree of height increase of a developer layer is a little too low when the thickness of the developer layer is regulated. On the other hand, if the magnetic flux density is higher than 60 mT, the degree of height increase of a developer layer is so high that high stress is likely imposed on the developer G in regulating the thickness of the developer layer.

Figure 2A:
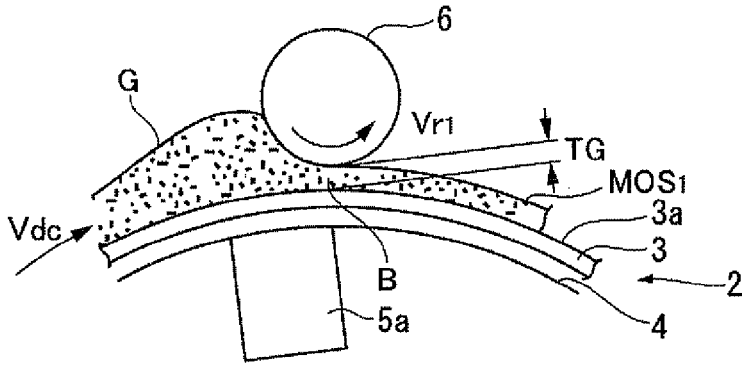
FIGS. 2A, 2B and 2C illustrate how a portion, near a layer regulating rotary body, of developer behaves when the circumferential speed $v_r$ of the layer regulating rotary body of a developing device shown in FIG. 1 is equal to $v_{r1}$, equal to $v_{r2}$ ($>v_{r1}$), and equal to 0 or a negative value, respectively.

FIG. 2A shows an example preferable layout involving the layer restricting magnetic pole 5*a*. In the magnet member 4 of the developer holding body 2, the layer restricting magnetic pole 5*a* is disposed so that the peak magnetic flux density position is located upstream of the region where layer regulating rotary body 6 and the development rotary body 3 are closest to each other in the developer conveying direction.

Where the peak magnetic flux density position of the layer restricting magnetic pole 5*a* is located upstream of the region where layer regulating rotary body 6 and the development rotary body 3 are closest to each other in the developer conveying direction, the developer G passes that region as its height decreases and hence the stress on the developer G is low. If the peak magnetic flux density position of the layer restricting magnetic pole 5*a* are located in the closest region, high stress would likely be imposed on the developer G in regulating the thickness of the developer layer because the height of the developer would be increased very much there. On the other hand, if the peak magnetic flux density position of the layer restricting magnetic pole 5*a* are located downstream of the closest region in the developer conveying direction, high stress would likely be imposed on the developer G in regulating the thickness of the developer layer because the developer G would pass the closest region as its height increases.

In a preferable mode of the layer regulating rotary body 6, it has a smooth surface whose surface roughness is lower than or equal to 5 μm in terms of maximum height. If the surface roughness of the layer regulating rotary body 6 is set higher than 5 μm, the conveying force produced by the rotation of the layer regulating rotary body 6 would increase because of the high surface roughness, whereby the thickness of a developer layer varies too much when the circumferential speed $v_r$ of the layer regulating rotary body 6 is varied. It is therefore preferable that the surface roughness of the layer regulating rotary body 6 be low.

It is preferable that the gap between the layer regulating rotary body 6 and the development rotary body 3 at the layer regulating position B be set to 60 μm to 1 mm. If the gap is smaller than 60 μm, a developer layer would be too dense at the layer regulating position B. On the other hand, if the gap is larger than 1 mm, a developer layer would be too sparse at the layer regulating position B. The range between these two values is thus preferable for the regulation of the thickness of a developer layer.

In a preferable mode of the development driving device 11, whereas it rotationally drives the development rotary body 3, it stops rotational driving of the layer regulating rotary body 6 or rotationally drives the layer regulating rotary body 6 in such a manner that a portion, facing the development rotary body 3, of the layer regulating rotary body 6 is moved in the direction opposite to a movement direction of a corresponding portion of the development rotary body 3, whereby the conveyance rate of developer (on the developer holding body 2) that has passed the layer regulating rotary body 6 and is moving toward the development position A between the image holding body 1 and the developer holding body 2 is made approximately equal to zero. In this mode, since the development rotary body 3 is driven rotationally and the layer regulating rotary body 6 is not driven rotationally or is driven rotationally in such a manner that a portion, facing the development rotary body 3, of the layer regulating rotary body 6 is moved in the direction opposite to a movement direction of a corresponding portion of the development rotary body 3, a developer layer that is held by the developer holding body 2 cannot pass the layer regulating position B between the layer regulating rotary body 6 and the developer holding body 2 (i.e., the developer G is stopped there). This phenomenon would be explained as follows. When an upper portion of a developer layer is stopped or pushed back by the layer regulating rotary body 6, a lower portion of the developer layer slips on the smooth surface 3*a* of the development rotary body 3 and the entire developer layer is thus stopped at the layer regulating position B.

In a typical mode of the development driving device 11, it has a calculating section 12 for calculating a conveyance rate of developer to be used for development according to use conditions of the image forming apparatus and a circumferential speed determining section 13 for determining a circumferential speed of the layer regulating rotary body 6 so that the developer conveyance rate calculated by the calculating section 12 is obtained.

The calculating section 12 may be of a type in which sets of use condition items of the image forming apparatus are correlated with respective developer conveyance rates. The use conditions of the image forming apparatus broadly include the following:

(1) Image information relating to an electrostatic latent image to be developed. With the use of this information, an optimum developer conveyance rate is calculated for each of an image such as a text image in which importance is attached to thin lines and a high-density image, whereby both of a fine image and a high-density image can be increased in image quality.

(2) Use history information (i.e., the number of images formed) and environmental information. Even if the charging characteristic of developer is varied as the image forming apparatus is used for a long time or due to an environmental change, the development characteristics can be corrected by calculating an optimum developer conveyance rate that is suitable for a use history and environmental conditions.

The circumferential speed determining section 13 may be of a type in which developer conveyance rates and circumferential speeds of the layer regulating rotary body 6 are correlated with each other. The circumferential speed determining section 13 determines a circumferential speed of the layer regulating rotary body 6 on the basis of the calculated developer conveyance rate.

Next, a description will be made of how the developing device 10 according to the general exemplary embodiment operates.

For example, when the development rotary body 3 is rotated at a preset circumferential speed $v_d=v_{dc}$ (see FIGS. 1 and 2A), developer G that is held by the development rotary body 3 is rotated by magnetic force that is produced by the magnetic flux density distribution of the poles 5 of the magnet member 4 and reaches the layer regulating position B between the development rotary body 3 and the layer regulating rotary body 6. If it is assumed that the layer regulating rotary body 6 is rotating at a circumferential speed $v_r=v_{r1}$, an upper portion of developer G that is held by the development rotary body 3 receives conveying force produced by the rotation of the layer regulating rotary body 6 and developer G passes the layer regulating position B and is conveyed toward the development position A at a conveyance rate $MOS_1$.

Figure 2B:
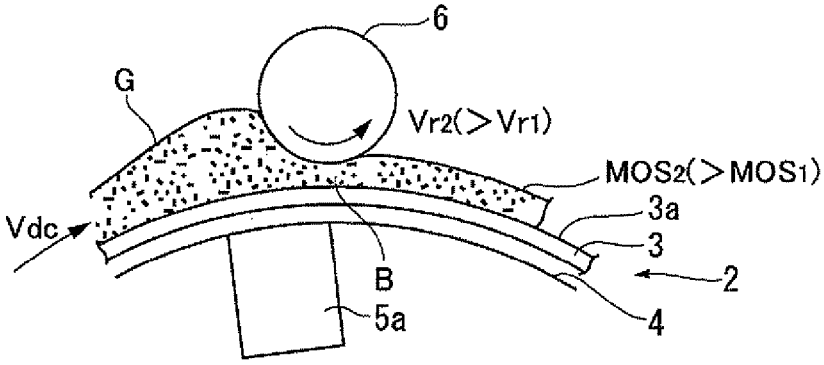

If it is assumed that as shown in FIGS. 1 and 2B the circumferential speed $v_r$ of the layer regulating rotary body 6 is increased from $v_{r1}$ to $v_{r2}$ ($>v_{r1}$), an upper portion of developer G that is held by the development rotary body 3 receives stronger conveying force produced by the rotation of the layer regulating rotary body 6 and developer G passes the layer regulating position B than in the case of FIG. 2A and is conveyed toward the development position A at a higher conveyance rate $MOS_2$ ($>MOS_1$).

Conversely, if the circumferential speed $v_r$ of the layer regulating rotary body 6 is decreased from $v_{r1}$, the conveying force produced by the rotation of the layer regulating rotary body 6 and acting on developer G is weakened and hence the conveyance rate is decreased.

Figure 2C:
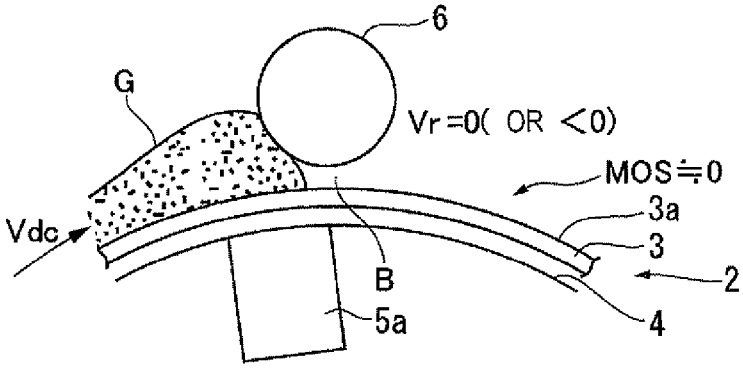

If as shown in FIGS. 1 and 2C the rotational driving of the layer regulating rotary body 6 is stopped ($v_r=0$) with the development rotary body 3 kept rotating at the circumferential speed $v_d=v_{dc}$, the conveying force produced by the rotation of the layer regulating rotary body 6 and acting on developer G becomes zero and hence an upper portion of the developer G that is held by the development rotary body 3 is stopped by the non-rotating layer regulating rotary body 6 and its lower portion slips on the smooth surface 3*a* of the development rotary body 3. The developer G does not pass the layer regulating position B and stays upstream of it. Therefore, no developer G reaches the development position A past the layer regulating position B and no developer G is held by a portion, located at the development position A, of the development rotary body 3.

If as shown in FIGS. 1 and 2C a portion, located at the layer regulating position B, of the layer regulating rotary body 6 is moved in the rotation direction that is opposite to the rotation direction of a corresponding portion of the development rotary body 3 ($v_r<0$), developer G receives resistive force that is produced by the reverse rotation of the layer regulating rotary body 6 and obstructs the conveyance of the developer G. Therefore, an upper portion of the developer G that is held by the development rotary body 3 is pushed back in the direction opposite to the developer conveying direction by the reversely-rotating layer regulating rotary body 6 and its lower portion slips on the smooth surface 3*a* of the development rotary body 3. The developer G does not pass the layer regulating position B and stays upstream of it. Therefore, no developer G reaches the development position A past the layer regulating position B and no developer G is held by a portion, located at the development position A, of the development rotary body 3.

Next, preferable modes of various kinds of image forming apparatus will be described. Each of these image forming apparatus employs the developing device 10 in which whereas the development rotary body 3 is driven rotationally, it stops rotational driving of the layer regulating rotary body 6 or rotationally drives the layer regulating rotary body 6 in such a manner that a portion, facing the development rotary body 3, of the layer regulating rotary body is moved in a direction opposite to a movement direction of a corresponding portion of the development rotary body 3, whereby the conveyance rate of developer held on the developer holding body 2 that has passed the layer regulating rotary body 6 and is moving toward the development position A between the image holding body 1 and the developer holding body 2 is made approximately equal to zero.

First, a description will be made of a preferable mode of an image forming apparatus that employs an image forming method in which a single image holding body 1 is rotated plural times. This image forming apparatus is equipped with an image holding body 1 capable of holding toner images of respective color components; a latent image forming device 9 for forming electrostatic latent images of the respective color components on the image holding body 1; and plural developing devices 10 provided around the image holding body 1, for developing, sequentially, with respective color toners, the electrostatic latent images of the respective color components formed on the image holding body 1. In a developing device 10 that is in a non-operating state, the development driving device 11 shuts out the supply of developer to the development position A between the image holding body 1 and the developer holding body 2 by stopping rotational driving of the layer regulating rotary body 6 or rotationally driving the layer regulating rotary body 6 in such a manner that a portion, facing the development rotary body 3, of the layer regulating rotary body 6 is moved in a direction opposite to a movement direction of a corresponding portion of the development rotary body 3 while rotationally driving the development rotary body 3, and then stops the rotational driving of the development rotary body 3. In this mode, a state that no developer exits at the development position A is established because the supply of developer to the development position A between the image holding body 1 and the developer holding body 2 is shut out by stopping rotational driving of the layer regulating rotary body 6 or rotationally driving the layer regulating rotary body 6 in such a manner that a portion, facing the development rotary body 3, of the layer regulating rotary body 6 is moved in a direction opposite to a movement direction of a corresponding portion of the development rotary body 3.

Next, a description will be made of a preferable mode of an image forming apparatus that employs a tandem image forming method. This image forming apparatus is equipped with plural image holding bodies 1 capable of holding toner images of color components, respectively; a latent image forming device 9 for forming electrostatic latent images of the color components on the image holding bodies 1, respectively; plural developing devices 10 provided for the respective image holding bodies 1, for developing, with color toners, the electrostatic latent images of the color components formed on the image holding bodies 1, respectively; and an image formation control device (not shown) for switching between a multi-color image formation control process for formation of a multi-color image and a monochrome image formation control process for formation of a monochrome image. When the image formation control device switches from the multi-color image formation control process to the monochrome image formation control process, in a developing device 10 that is in a non-operating state, the development driving device 11 shuts out the supply of developer to the development position A between the image holding body 1 and the developer holding body 2 by stopping rotational driving of the layer regulating rotary body 6 or rotationally driving the layer regulating rotary body 6 in such a manner that a portion, facing the development rotary body 3, of the layer regulating rotary body 6 is moved in a direction opposite to a movement direction of a corresponding portion of the development rotary body 3 while rotationally driving the development rotary body 3, and then stops the rotational driving of the development rotary body 3. In this mode, when switching is made from the multi-color image formation control process to the monochrome image formation control process, in a developing device 10 that is in a non-operating state, a state that no developer exits at the development position A is established because the supply of developer to the development position A between the image holding body 1 and the developer holding body 2 is shut out before the rotational driving of the development rotary body 3 is stopped by stopping rotational driving of the layer regulating rotary body 6 or rotationally driving the layer regulating rotary body 6 in such a manner that a portion, facing the development rotary body 3, of the layer regulating rotary body 6 is moved in a direction opposite to a movement direction of a corresponding portion of the development rotary body 3.

Finally, a description will be made of a preferable mode of an image forming apparatus that is equipped with a rotary developing assembly. This image forming apparatus is equipped with an image holding body 1 capable of holding toner images of respective color components; a latent image forming device 9 for forming electrostatic latent images of the respective color components on the image holding body 1; and a rotary developing assembly (not shown) in which plural developing devices 10 for developing, with respective color toners, the electrostatic latent images of the respective color components formed on the image holding body 1 are supported rotatably by a rotary support body (not shown) and which is rotated so that a developing device to be opposed to the image holding body 1 at the development position A is selected. When a developing operation is finished in each developing device 10 of the rotary developing assembly, the development driving device 11 shuts out the supply of developer to the development position A between the image holding body 1 and the developer holding body 2 by stopping rotational driving of the layer regulating rotary body 6 or rotationally driving the layer regulating rotary body 6 in such a manner that a portion, facing the development rotary body 3, of the layer regulating rotary body 6 is moved in a direction opposite to a movement direction of a corresponding portion of the development rotary body 3 while rotationally driving the development rotary body 3, then stops the rotational driving of the development rotary body 3, and then causes rotation of the rotary developing assembly so that a developing device 10 of the next color component is selected. In this mode, the developing device 10 of each color component is selected in such a manner that it is rotated being supported by the rotary support body. When a developing operation is finished in each developing device 10, a state that no developer exits at the development position A is established because the supply of developer to the development position A between the image holding body 1 and the developer holding body 2 is shut out before the rotational driving of the development rotary body 3 is stopped by stopping rotational driving of the layer regulating rotary body 6 or rotationally driving the layer regulating rotary body 6 in such a manner that a portion, facing the development rotary body 3, of the layer regulating rotary body 6 is moved in a direction opposite to a movement direction of a corresponding portion of the development rotary body 3.

The invention will be described below in more detail using specific exemplary embodiments with reference to the accompanying drawings.

Exemplary Embodiment 1

—Entire Configuration of Image Forming Apparatus—

Figure 3:
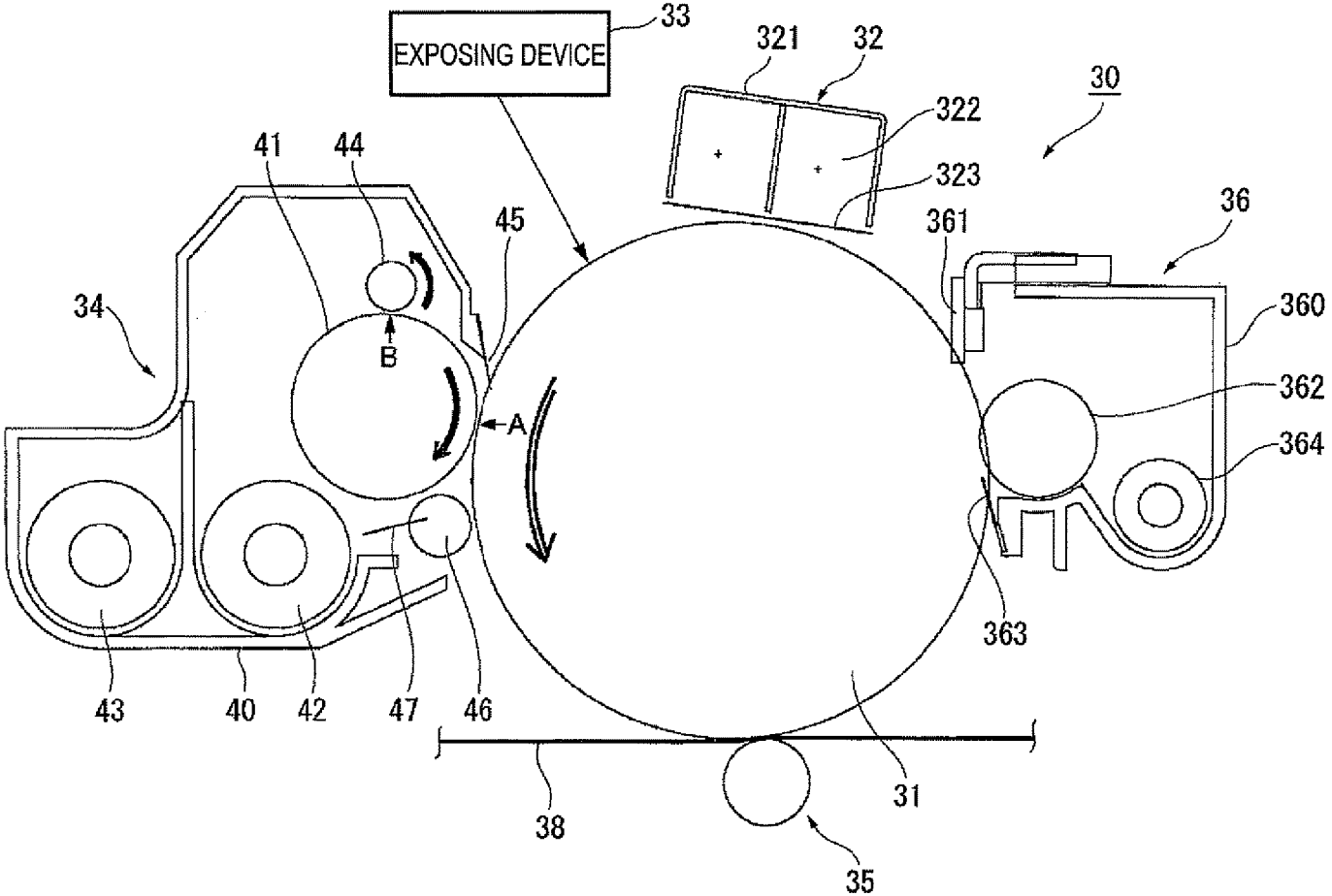
FIG. 3 illustrates the entire configuration of an image forming apparatus according to a first exemplary embodiment.

FIG. 3 illustrates the entire configuration of an image forming apparatus according to a first exemplary embodiment.

As shown in FIG. 3, an image forming apparatus 30 is equipped with a drum-shaped photoreceptor body 31 as an image holding body, a charging device 32 for charging the photoreceptor body 31, an exposing device 33 for writing, with light, an electrostatic latent image on the photoreceptor body 31 that has been charged by the charging device 32, a developing device 34 for visualizing, with developer (toner), the electrostatic latent image that has been written on the photoreceptor body 31, a transfer device 35 for transferring a toner image (visualized image) produced by the developing device 34 to a recording medium (transfer destination medium) 38, and a cleaning device 36 for cleaning out residual toner remaining on the photoreceptor body 31 after the transfer of the toner image by the transfer device 35.

In this exemplary embodiment, the transferred image on the recording medium 38 is fused by a fusing device (not shown) and then the recording medium 38 is ejected. Although in this exemplary embodiment the transfer destination medium is a recording medium 38, the invention is not limited to such a case and the transfer destination medium may include an intermediate transfer body which holds a toner image temporarily before it is transferred to a recording medium 38.

For example, the charging device 32 has a charging container 321 and a discharge wire 322 and a grid electrode 323 are provided in the charging container 321 as charging members. However, the structure of the charging device 32 is not limited to it. For example, any of other types of charging devices such as one having a roll-shaped charging member may be employed as appropriate.

The exposing device 33 is a laser scanning device, an LED array, or the like.

The developing device 34 is of a two-component development type which uses two-component developer containing a toner and a carrier. The details of the developing device 34 will be described later.

The transfer device 35 may be of such a type as to be able to produce a transfer electric field for electrostatically transferring a toner image on the photoreceptor body 31 to a recording medium 38, and uses, for example, a roll-shaped transfer member to which a transfer bias is applied. However, the invention is not limited to such a case. Any of other types of transfer devices such as a transfer corotron which uses a discharge wire may be employed as appropriate.

The cleaning device 36 has a cleaning container 360 which is opened on the side of the photoreceptor body 31 and serves to house residual toner. A plate-like cleaning member 361 such as a blade or a scraper is attached to the edge, located on the downstream side in the rotation direction of the photoreceptor body 31, of the opening of the cleaning container 360. A brush-shaped or roll-shaped rotary cleaning member 362 is disposed upstream of the plate-like cleaning member 361 in the rotation direction of the photoreceptor body 31. A sealing member 363 is attached to the edge, located on the upstream side in the rotation direction of the photoreceptor body 31, of the opening of the cleaning container 360. A transport member 364 for transporting cleaned-out residual toner to collect and discard it is disposed below the rotary cleaning member 362 in the cleaning container 360. For example, the transport member 364 is of a type in which a spiral blade is formed around a rotary shaft member.

—Developing Device—

In this exemplary embodiment, the developing device 34 has a development container 40 which is opened on the side of the photoreceptor body 31 and serves to house a two-component developer containing a toner and a carrier. A developing roll 41 capable of holding and conveying developer is disposed in the development container 40 at such a position as to be opposed to the photoreceptor body 31. Stirring and transporting members 42 and 43 for stirring and transporting developer to charge the toner through friction are disposed in the development container 40 behind the developing roll 41 so as to be arranged in the horizontal direction, for example. Developer that has been stirred and transported by the stirring and transporting members 42 and 43 is given to the developing roll 41, the thickness of a developer layer on the developing roll 41 is then regulated by a layer regulating member 44, and developer is finally supplied to the photoreceptor body 31 at a development position A where the developing roll 41 faces the photoreceptor body 31.

Figure 5A:
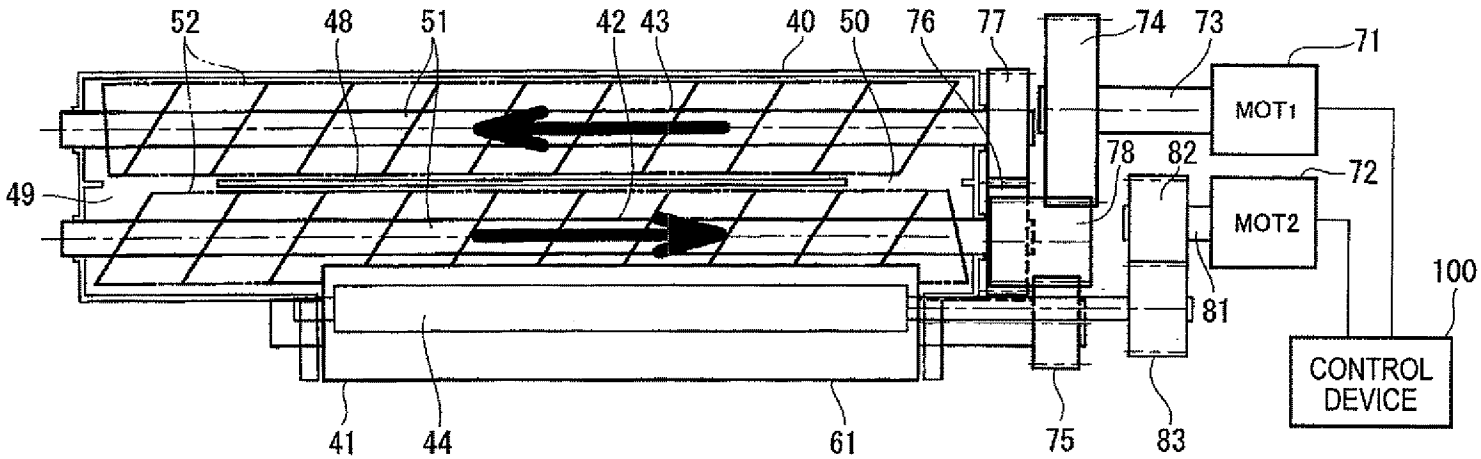
FIG. 5A illustrates drive power transmission systems of the developing device according to the first exemplary embodiment, and FIG. 5B schematically illustrates how they perform driving.

As shown in FIG. 5A, the internal space of the development container 40 is divided by a partition plate 48 which extends in the axial direction of the developing roll 41. Communication holes 49 and 50 are formed around both ends of the partition plate 48 in its longitudinal direction. The stirring and transporting members 42 and 43 in each of which, for example, a spiral blade 52 is formed around a rotary shaft member 51 are disposed in the respective spaces separated by the partition plate 48. Developer is transported (circulated) by the stirring and transporting members 42 and 43 and the communication holes 49 and 50.

A sealing member 45 is attached to the top edge of the opening of the development container 40. A collection roll 46 for collecting suspended toner is disposed downstream of the development position A in the rotation direction of the photoreceptor body 31. Suspended toner etc. collected by the collection roll 46 are raked off by a raking member 47 and returned to inside the development container 40.

<Developing Roll>

In this exemplary embodiment, the developing roll 41 is opposed to the photoreceptor body 31 at the development position A with a gap formed between them (i.e., they are not in contact with each other). The gap distance is set so that developer fills the gap between the photoreceptor body 31 and the developing roll 41 when the developer is conveyed, being held on the developing roll 41, to the development position A at a developer conveyance rate (MOS: mass on the sleeve) necessary for development.

Figure 4A:
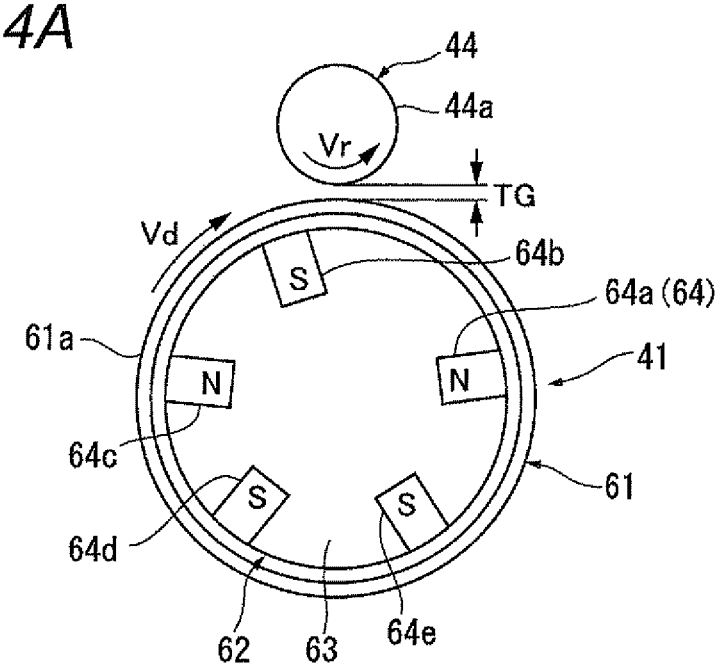
FIG. 4A illustrates a layout of a developing roll and a rotary trimmer of the developing device according to the first exemplary embodiment.
Figure 4B:
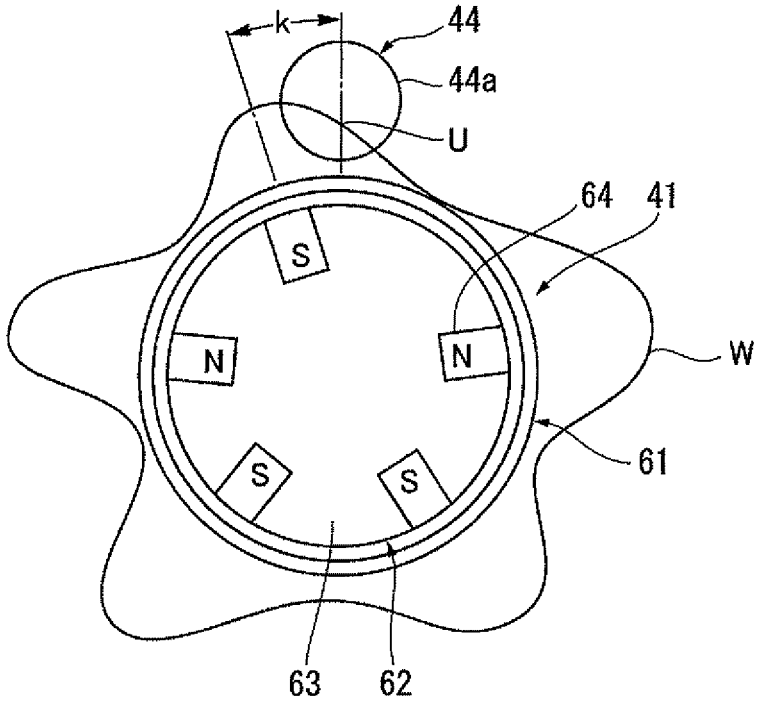
FIG. 4B illustrates an example magnetic flux density distribution of the magnetic poles of a magnet roll of the developing roll.

As shown in FIGS. 4A and 4B, the developing roll 41 is equipped with a rotatable, cylindrical developing sleeve 61 made of a non-magnetic material (e.g., SUS304) and a magnet roll 62 which is fixedly housed in the developing sleeve 61.

In this exemplary embodiment, the developing sleeve 61 has a smooth surface 61*a*. For example, the smooth surface 61*a* is formed by polishing the surface of a non-magnetic raw pipe of the developing sleeve 61 and its surface roughness is set lower than or equal to 5 μm in terms of maximum height Rz (JIS B0601 2001).

As shown in FIGS. 4A and 4B, in the magnet roll 62, plural magnetic poles 64 (in this exemplary embodiment, five magnetic poles 64*a*-64*e*) are arranged alongside the periphery of a non-magnetic roll member 63. More specifically, the magnetic poles 64 include a development magnetic pole 64*a* (in this exemplary embodiment, N pole; disposed adjacent to the development position A) for development of developer, a layer regulating magnetic pole 64*b* (S pole; disposed adjacent to the layer regulating position B) for regulating the thickness of a developer layer, an absorption magnetic pole 64*d* (S pole) for causing developer to be absorbed and held on the developing roll 41, a conveying magnetic pole 64*c* (N pole; disposed between the layer regulating magnetic pole 64*b* and the absorption magnetic pole 64*d*) for conveying developer, and a peeling magnetic pole 64*e* (S pole; disposed between the development magnetic pole 64*a* and the absorption magnetic pole 64*d*) for peeling developer off the developing roll 41 by producing a repulsive magnetic field between itself and the absorption magnetic pole 64*d*. The development magnetic pole 64*a*, the layer regulating magnetic pole 64*b*, the absorption magnetic pole 64*d*, and the peeling magnetic pole 64*e* function as conveying magnetic poles together with adjacent magnetic poles having the opposite polarities.

The magnetic flux density distribution W of the magnetic poles 64 (64*a*-64*e*) of the magnet roll 62 is set so as to be able to hold and convey developer on the developing sleeve 61 by resulting magnetic force when the developing sleeve 61 is rotated.

<Layer Regulating Member>

As shown in FIG. 4A, the layer regulating member 44 is a rotatable roll-shaped member (hereinafter also referred to as "rotary trimmer" when necessary) and its portion facing the developing sleeve 61 is moved at least in the same direction as a corresponding portion of the developing sleeve 61.

The layer regulating member (rotary trimmer) 44 is opposed to the developing sleeve 61 with a predetermined gap TG formed between them (i.e., they are not in contact with each other). The gap distance TG is set as appropriate in a range of 0.035 to 1.5 mm, for example, so that a proper developer conveyance rate (MOS) is obtained at the development position A.

The layer regulating member (rotary trimmer) 44 is made of a non-magnetic material (e.g., SUS304) or a magnetic material (e.g., SUS416) and has a smooth surface 44*a*. The smooth surface 44*a* is formed by polishing the surface of a raw pipe of the layer regulating member (rotary trimmer) 44 and its surface roughness is set lower than or equal to 5 μm in terms of maximum height Rz (JIS B0601 2001).

As shown in FIG. 4B, the layer regulating member (rotary trimmer) 44 is disposed near the layer regulating magnetic pole 64*b* of the developing roll 41. In this exemplary embodiment, the layer regulating position B where the layer regulating member (rotary trimmer) 44 is closest to the developing roll 41 is deviated downstream in the developer conveying direction by k from the peak magnetic flux density position of the layer regulating magnetic pole 64*b*. As a result, a magnetic flux density U of 30 to 60 mT is obtained at the above closest position.

<Drive Power Transmission Systems>

FIG. 5A shows drive power transmission systems of the developing device 34 according to this exemplary embodiment. As shown in FIG. 5A, the developing device 34 is driven by two drive motors ($MOT_1$ and $MOT_2$) 71 and 72.

In a drive power transmission system corresponding to the one drive motor ($MOT_1$) 71, a drive gear 74 is attached to a motor drive shaft 73 concentrically. Transmission gears 75-77 are attached concentrically to one end of a rotary shaft of the developing sleeve 61 of the developing roll 41 and one ends of rotary shafts of the stirring and transporting members 42 and 43, respectively, and the transmission gears 76 and 77 are engaged with each other. An intermediate transmission gear 78 is disposed between and engaged with the drive gear 74 and the transmission gear 76, and is engaged with the transmission gear 75.

In a drive power transmission system corresponding to the other drive motor ($MOT_2$) 72, a drive gear 82 is attached to a motor drive shaft 81 concentrically. A transmission gear 83 is attached to a rotary shaft of the layer regulating member (rotary trimmer) 44 concentrically and engaged with the drive gear 82.

Each of the drive motors 71 and 72 is driven rotationally or stopped on the basis of a control signal that is supplied from a control device 100.

Figure 5B:
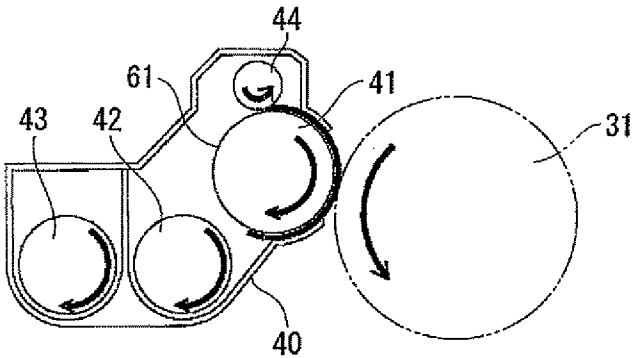

In this exemplary embodiment, as shown in FIGS. 5A and 5B, the one drive motor 71 rotationally drive or stop the stirring and transporting members 42 and 43 together. The other drive motor 72 rotationally drives or stops the layer regulating member (rotary trimmer) 44.

<Drive Control System>

Figure 6:
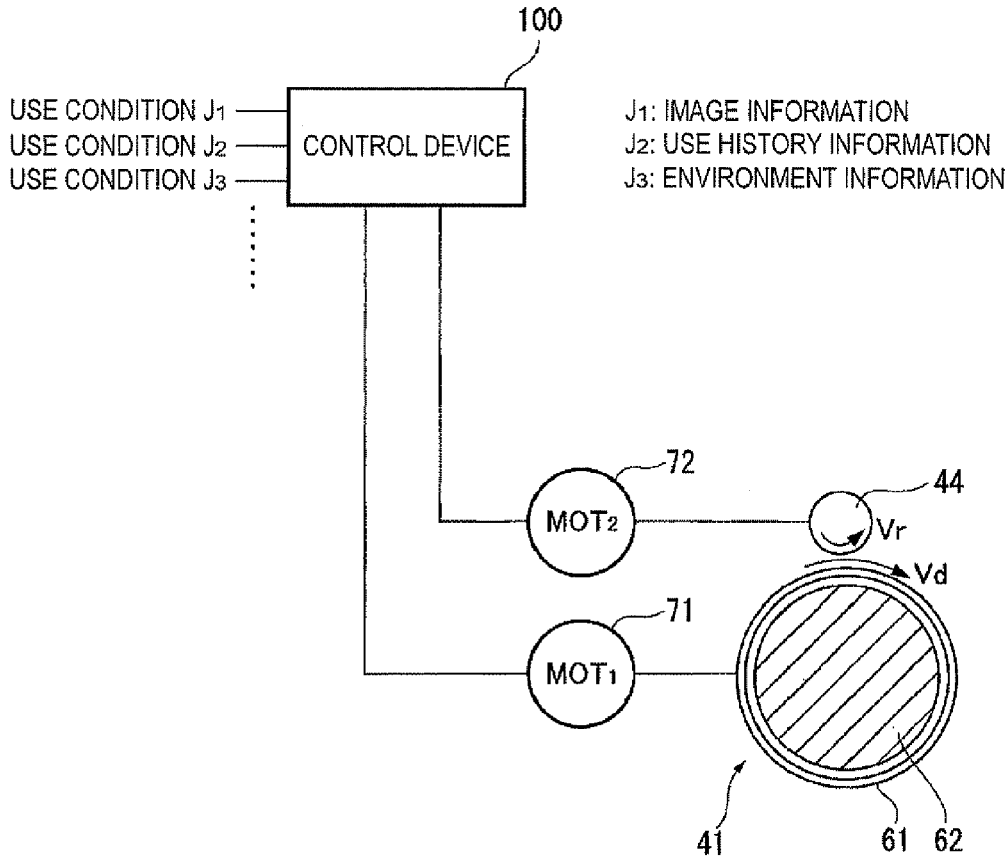
FIG. 6 illustrates a drive control system of the developing device according to the first exemplary embodiment.

In this exemplary embodiment, the control device 100 is a computer system having a CPU, a RAM, a ROM, and input/output ports. As shown in FIG. 6, for example, the control device 100 receives use conditions J (e.g., $J_1$-$J_3$) of the image forming apparatus 30 as input signals. The CPU runs development drive control programs (see FIGS. 7-9, for example) which are preinstalled in the ROM. The control device 100 thus supplies control signals to the two drive motors ($MOT_1$ and $MOT_2$) 71 and 72, and drive-controls the developing sleeve 61 of the developing roll 41 and the layer regulating member (rotary trimmer) 44 by means of the drive motors 71 and 72.

In this exemplary embodiment, the circumferential speed $v_d$ of the developing sleeve 61 of the developing roll 41 is set at a predetermined constant value and the circumferential speed $v_r$ of the layer regulating member (rotary trimmer) 44 is variably set in a range of a predetermined lower limit value $v_{min}$ and an upper limit value $v_{max}$.

—Development Drive Control Processes—

Next, development drive control processes which are execute by the developing device 34 according to this exemplary embodiment will be described. The development drive control processes include the following.

<MOS Control Using Image Information>

Figure 7:
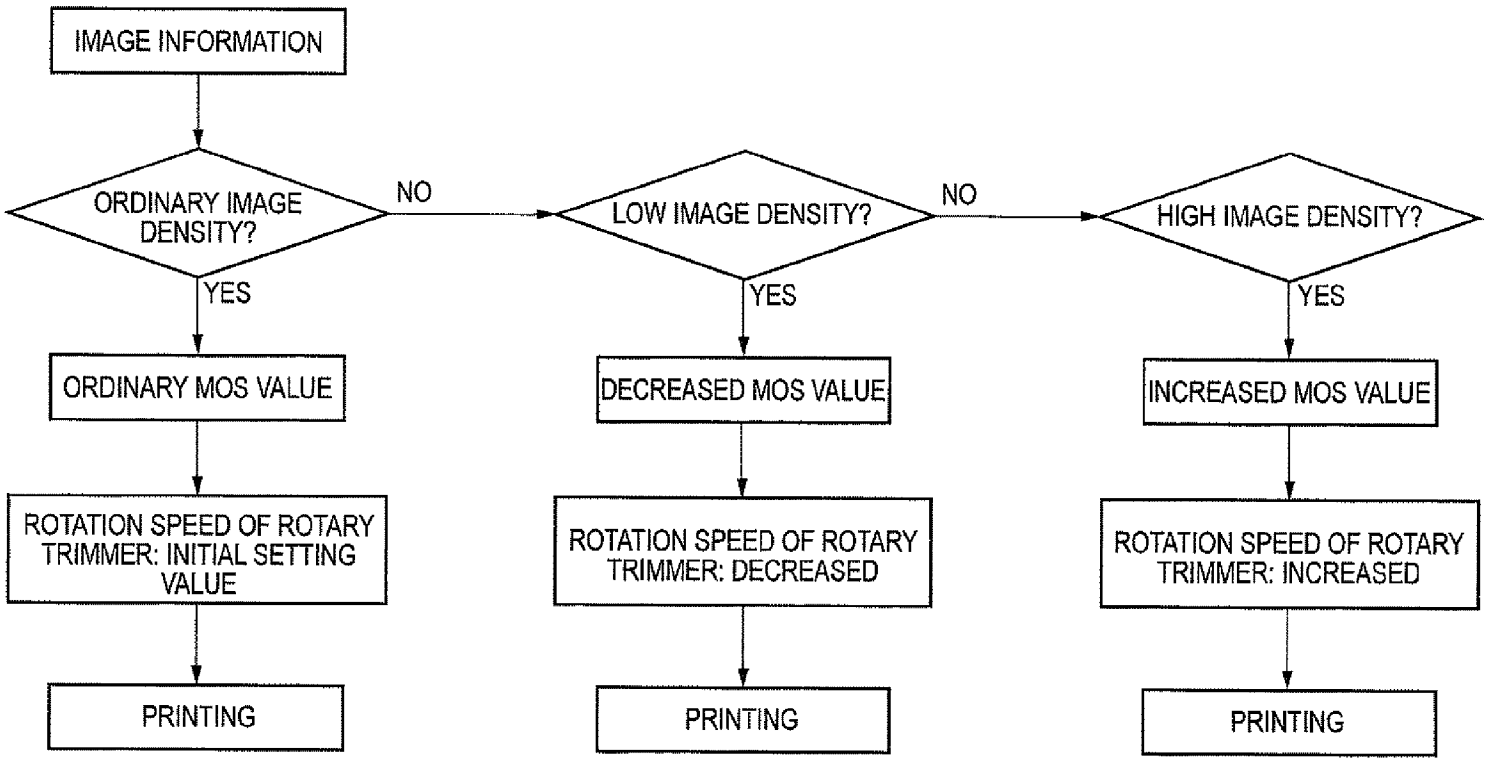
FIG. 7 is a flowchart of an example MOS (mass on the sleeve) control using image information in the drive control system of the developing device according to the first exemplary embodiment.

In this control, as shown in FIG. 7, attention is paid to the image density which is image information $J_1$. It is judged whether the image density comes under a low image density, a high image density, or an ordinary image density which is between the low image density and the high image density. In the case of an ordinary image (ordinary image density image), a print operation (development operation) is performed by setting the developer conveyance rate at an ordinary MOS value and setting the rotation speed (circumferential speed) $v_r$ of the layer regulating member (rotary trimmer) 44 at an initial setting value.

Figure 10A:
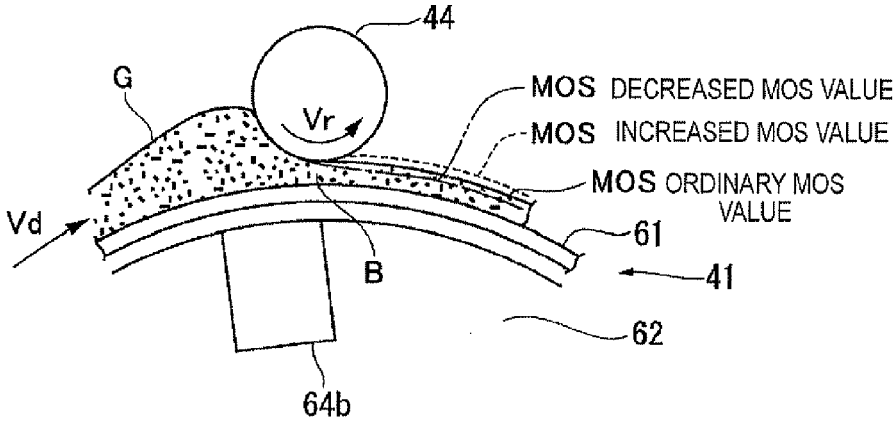
FIG. 10A illustrates how the developer conveyance rate varies when the circumferential speed $v_r$ of a rotary trimmer is varied in the drive control system of the developing device according to the first exemplary embodiment.

In this case, as shown in FIG. 10A, since the rotation speed (circumferential speed) $v_r$ of the layer regulating member (rotary trimmer) 44 is set at the initial setting value, conveying force is exerted on developer G as the rotary trimmer 44 rotates and developer G passes the layer regulating position B of the rotary trimmer 44 and reaches the development position A (see FIG. 3) at a developer conveyance rate (MOS) corresponding to the thus-set ordinary MOS value.

When the image information comes under the low image density, a print operation (development operation) is performed by setting the developer conveyance rate at a decreased MOS value and setting the rotation speed (circumferential speed) $v_r$ of the layer regulating member (rotary trimmer) 44 lower than the initial setting value.

In this case, as shown in FIG. 10A, weaker conveying force is exerted on developer G because of decrease in the rotation speed (circumferential speed) $v_r$ of the layer regulating member (rotary trimmer) 44 and developer G passes the layer regulating position B of the rotary trimmer 44 and reaches the development position A (see FIG. 3) at a developer conveyance rate (indicated by a two-dot chain line in FIG. 10A) corresponding to the thus-set decreased MOS value. Because of the decreased developer conveyance rate, a fine image is printed as a low image density image.

When the image information comes under the high image density, a print operation (development operation) is performed by setting the developer conveyance rate at an increased MOS value and setting the rotation speed (circumferential speed) $v_r$ of the layer regulating member (rotary trimmer) 44 higher than the initial setting value.

In this case, as shown in FIG. 10A, stronger conveying force is exerted on developer G because of increase in the rotation speed (circumferential speed) $v_r$ of the layer regulating member (rotary trimmer) 44 and developer G passes the layer regulating position B of the rotary trimmer 44 and reaches the development position A (see FIG. 3) at a developer conveyance rate (indicated by a broken line in FIG. 10A) corresponding to the thus-set increased MOS value. Because of the increased developer conveyance rate, a high image density image is printed.

<MOS Control Using Use History Information>

Figure 8:
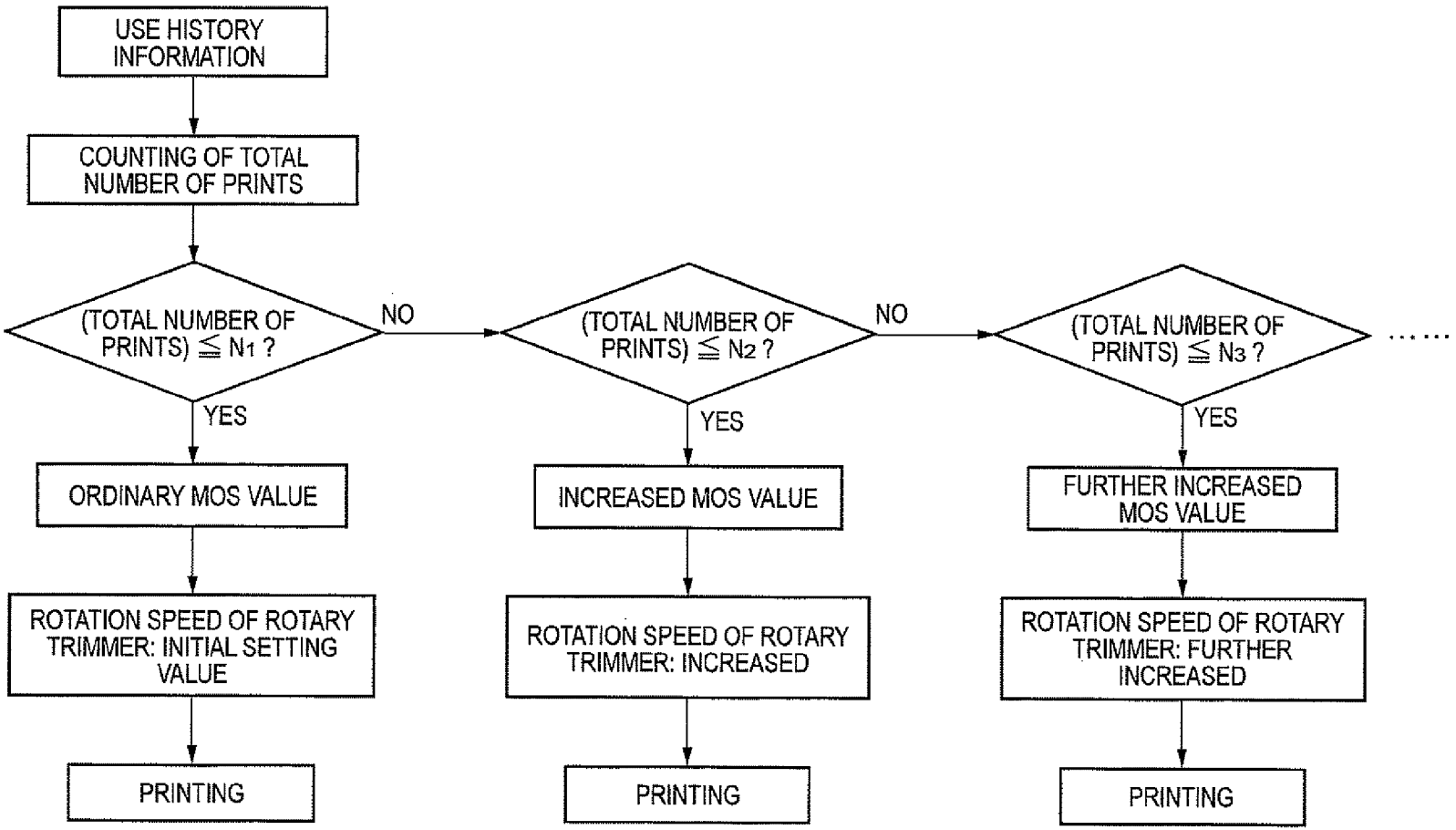
FIG. 8 is a flowchart of an example MOS control using use history information in the drive control system of the developing device according to the first exemplary embodiment.

In this control, as shown in FIG. 8, attention is paid to the number of prints which is use history information $J_2$. It is judged whether the number of prints is larger than predetermined threshold values $N_1$, $N_2$, and $N_3$ ($N_1<N_2<N_3$). If the total number of prints is smaller than or equal to $N_1$, a print operation (development operation) is performed by setting the developer conveyance rate at an ordinary MOS value and setting the rotation speed (circumferential speed) $v_r$ of the layer regulating member (rotary trimmer) 44 at an initial setting value.

In this case, as shown in FIG. 10A, since the rotation speed (circumferential speed) $v_r$ of the layer regulating member (rotary trimmer) 44 is set at the initial setting value, conveying force is exerted on developer G as the rotary trimmer 44 rotates and developer G passes the layer regulating position B of the rotary trimmer 44 and reaches the development position A (see FIG. 3) at a developer conveyance rate (MOS) corresponding to the thus-set ordinary MOS value.

When the total number of prints is larger than $N_1$ and smaller than or equal to $N_2$, a print operation (development operation) is performed by setting the developer conveyance rate at a decreased MOS value and setting the rotation speed (circumferential speed) $v_r$ of the layer regulating member (rotary trimmer) 44 higher than the initial setting value.

In this case, as shown in FIG. 10A, stronger conveying force is exerted on developer G because of increase in the rotation speed (circumferential speed) $v_r$ of the layer regulating member (rotary trimmer) 44 and developer G passes the layer regulating position B of the rotary trimmer 44 and reaches the development position A (see FIG. 3) at a developer conveyance rate (indicated by a broken line in FIG. 10A) corresponding to the thus-set increased MOS value.

When the total number of prints is larger than $N_2$ and smaller than or equal to $N_3$, a print operation (development operation) is performed by setting the developer conveyance rate at a further increased MOS value and setting the rotation speed (circumferential speed) $v_r$ of the layer regulating member (rotary trimmer) 44 even higher than the initial setting value.

In this case, as shown in FIG. 10A, even stronger conveying force is exerted on developer G because of further increase in the rotation speed (circumferential speed) $v_r$ of the layer regulating member (rotary trimmer) 44 and developer G passes the layer regulating position B of the rotary trimmer 44 and reaches the development position A (see FIG. 3) at a developer conveyance rate corresponding to the thus-set further increased MOS value.

<MOS Control Using Environment Information>

Figure 9:
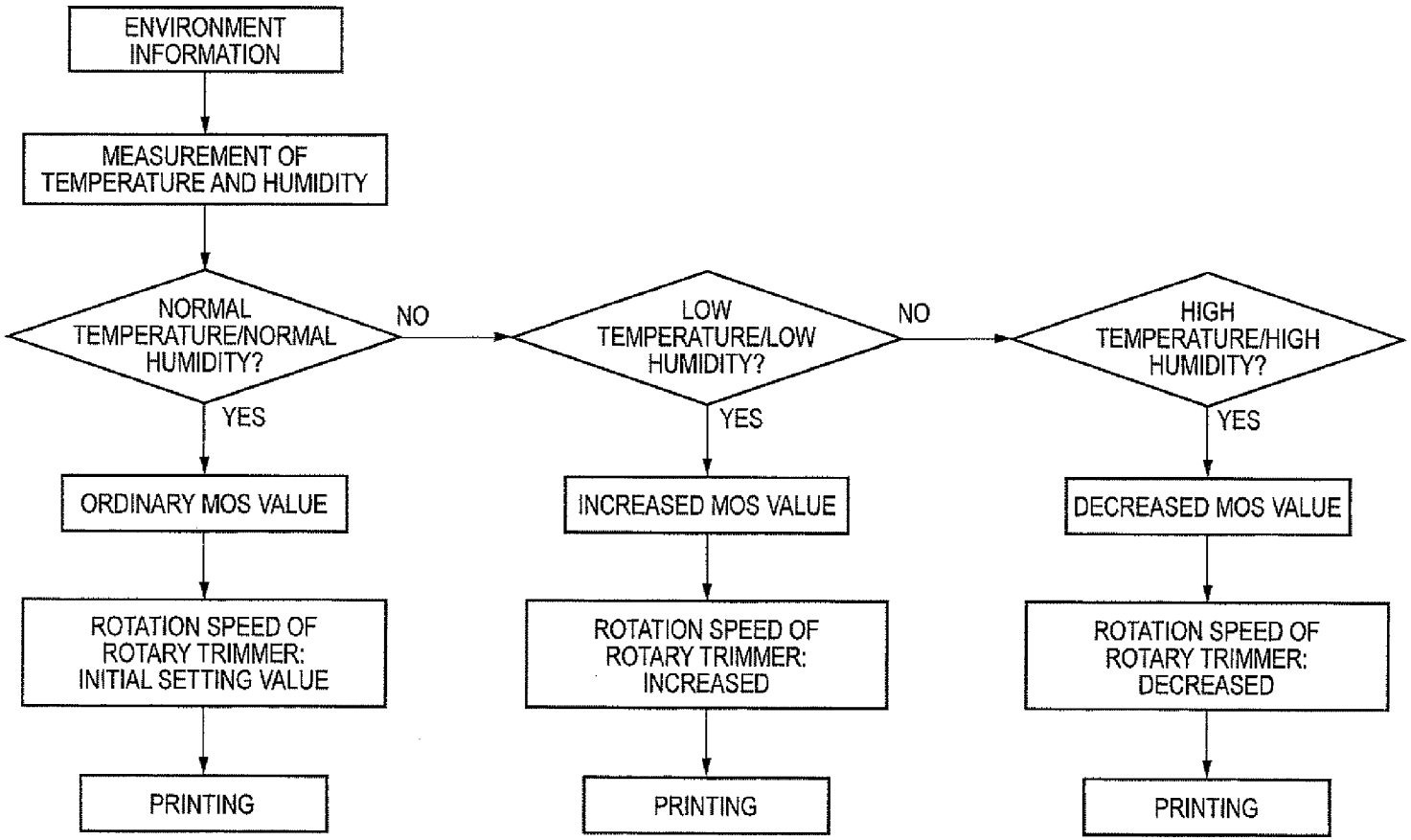
FIG. 9 is a flowchart of an example MOS control using environment information in the drive control system of the developing device according to the first exemplary embodiment.

In this control, as shown in FIG. 9, attention is paid to temperature and humidity which are environment information $J_3$. It is judged whether temperature and humidity come under a predetermined low-temperature/low-humidity environment, high-temperature/high-humidity environment, or normal temperature/normal humidity environment which is between the above two environments. If temperature and humidity come under the low-temperature/low-humidity environment, a print operation (development operation) is performed by setting the developer conveyance rate at an ordinary MOS value and setting the rotation speed (circumferential speed) $v_r$ of the layer regulating member (rotary trimmer) 44 at an initial setting value.

In this case, as shown in FIG. 10A, conveying force is exerted on developer G as the rotary trimmer 44 rotates and developer G passes the layer regulating position B of the rotary trimmer 44 and reaches the development position A (see FIG. 3) at a developer conveyance rate (MOS) corresponding to the thus-set ordinary MOS value.

When the environment information comes under the low-temperature/low-humidity environment, a print operation (development operation) is performed by setting the developer conveyance rate at an increased MOS value and setting the rotation speed (circumferential speed) $v_r$ of the layer regulating member (rotary trimmer) 44 higher than the initial setting value.

In this case, as shown in FIG. 10A, stronger conveying force is exerted on developer G because of increase in the rotation speed (circumferential speed) $v_r$ of the layer regulating member (rotary trimmer) 44 and developer G passes the layer regulating position B of the rotary trimmer 44 and reaches the development position A (see FIG. 3) at a developer conveyance rate (indicated by a broken line in FIG. 10A) corresponding to the thus-set increased MOS value. Because of the increased developer conveyance rate, printing is performed with high image quality in spite of the low-temperature/low-humidity environment.

When the environment information comes under the high-temperature/high-humidity environment, a print operation (development operation) is performed by setting the developer conveyance rate at a decreased MOS value and setting the rotation speed (circumferential speed) $v_r$ of the layer regulating member (rotary trimmer) 44 lower than the initial setting value.

In this case, as shown in FIG. 10A, weaker conveying force is exerted on developer G because of decrease in the rotation speed (circumferential speed) $v_r$ of the layer regulating member (rotary trimmer) 44 and developer G passes the layer regulating position B of the rotary trimmer 44 and reaches the development position A (see FIG. 3) at a developer conveyance rate (indicated by a two-dot chain line in FIG. 10A) corresponding to the thus-set decreased MOS value. Because of the decreased developer conveyance rate, printing is performed with high image quality in spite of the high-temperature/high-humidity environment.

—Layer Regulating Member Circumferential Speed Adjustment Process—

Figure 10B:
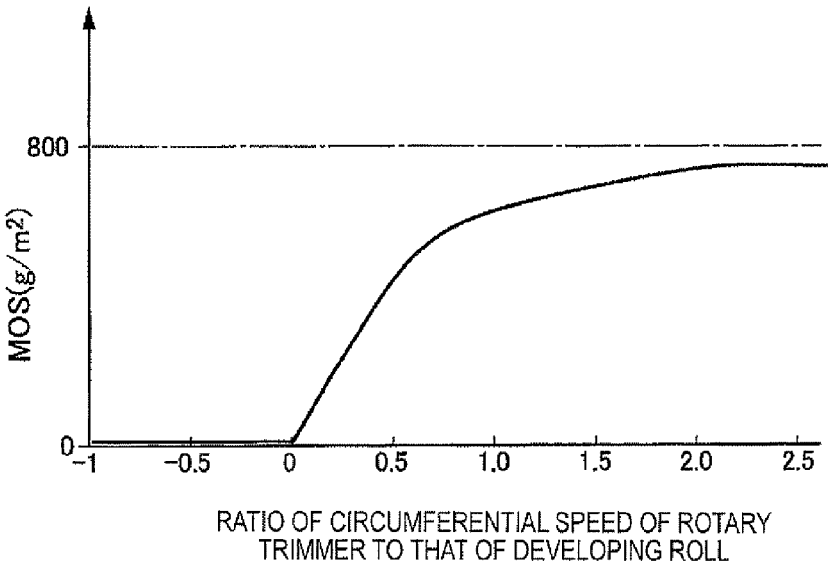
FIG. 10B is a graph showing a relationship between the circumferential speed ratio of the rotary trimmer and the developer conveyance rate.

In this exemplary embodiment, a MOS variation is measured when the circumferential speed $v_r$ of the layer regulating member (rotary trimmer) 44 is varied and a tendency shown in FIG. 10B is found.

The horizontal axis of the graph of FIG. 10B represents the ratio of the circumferential speed $v_r$ of the rotary trimmer 44 to that of the developing roll 41. It is understood that as the circumferential speed $v_r$ of the rotary trimmer 44 is varied under the condition that as shown in FIG. 10B a portion, facing the developing roll 41 (more specifically, developing sleeve 61), of the rotary trimmer 44 is moved in the same direction as a corresponding portion of the developing roll 41, the developer conveyance rate varies so as to have a maximum value of about 800 g/m$^2$.

Figure 11A:
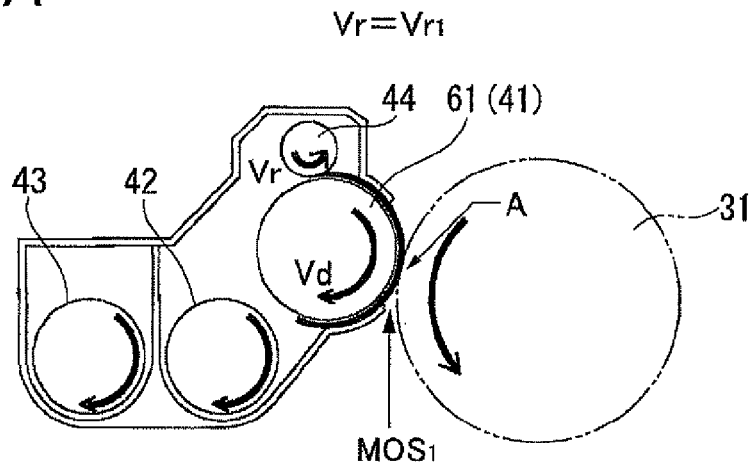
FIGS. 11A, 11B and 11C illustrate how the developer conveyance rate varies when the circumferential speed of a rotary trimmer is set at $v_{r1}$, $v_{r2}$ ($\neq v_{r1}$) and 0 (or a negative value), respectively, in the drive control system of the developing device according to the first exemplary embodiment.

Now assume that as shown in FIG. 11A developer G reaches the development position A at a conveyance rate $MOS_1$ when the circumferential speed $v_r$ of the rotary trimmer 44 is equal to $v_{r1}$ in a state that the developing roll 41 (more specifically, developing sleeve 61) is rotating at a constant circumferential speed $v_d$.

Figure 11B:
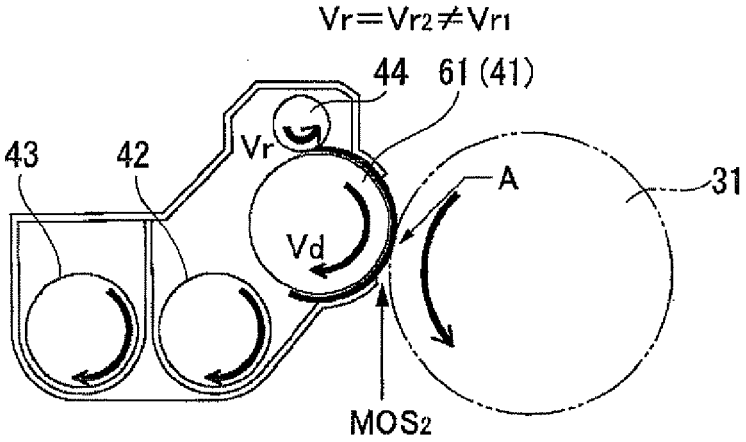

If as shown in FIG. 11B the circumferential speed $v_r$ of the rotary trimmer 44 is changed to $v_{r2}$ ($\neq v_{r1}$) with the developing roll 41 (more specifically, developing sleeve 61) kept rotating at the constant circumferential speed $v_d$, developer G comes to reach the development position A at a conveyance rate $MOS_2$ ($\neq MOS_1$). And the following relationships hold:

$$MOS_2 > MOS_1 \text{ if } v_{r2} > v_{r1}; \text{ and}$$

$$MOS_2 < MOS_1 \text{ if } v_{r2} < v_{r1}.$$

Figure 11C:
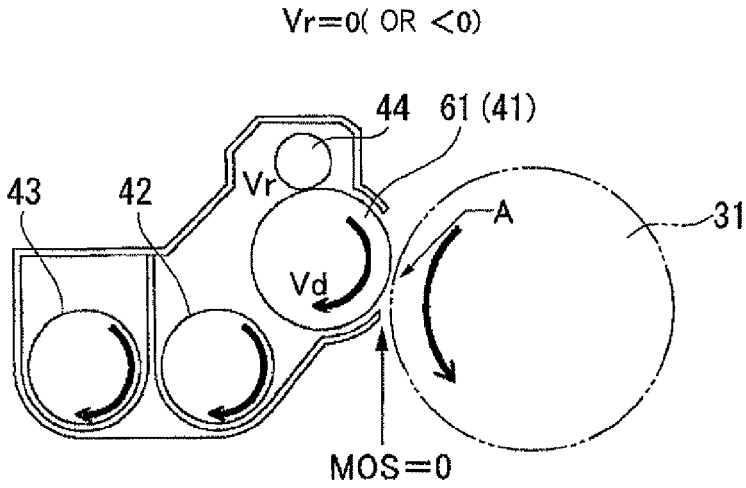

Furthermore, as shown in FIGS. 103 and 11C, if the rotational driving of the rotary trimmer 44 is stopped with the developing roll 41 (more specifically, developing sleeve 61) kept rotating at the constant circumferential speed $v_d$, the conveyance rate becomes zero. That is, the supply of developer G to the development position A is shut out.

The conveyance rate becomes zero also when the rotation direction of the rotary trimmer 44 is reversed with the developing roll 41 (more specifically, developing sleeve 61) kept rotating at the constant circumferential speed $v_d$ (also see FIGS. 10B and 11C). Therefore, the supply of developer G to the development position A is shut out as in the case that the rotational driving of the rotary trimmer 44 is stopped.

Exemplary Embodiment 2

Figure 12A:
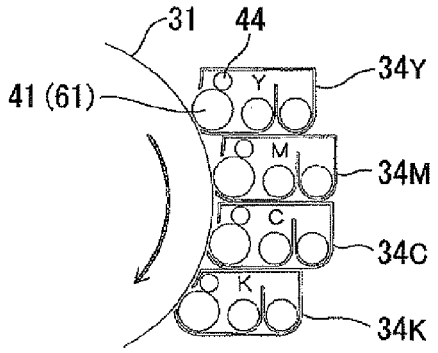
FIGS. 12A, 12B, 12C, 12D and 12E are a first set of diagrams showing how developing devices of respective color components operate in an image forming apparatus according to a second exemplary embodiment which employs an image forming method in which a single photoreceptor body is rotated plural times.

FIG. 12A shows an image forming apparatus according to a second exemplary embodiment. In this image forming apparatus, plural developing devices 34 (34Y, 34M, 34C, and 34K) which use toners of respective color components are disposed around a single photoreceptor body 31. As the photoreceptor body 31 is rotated plural times, toner images of the respective color components are formed sequentially on the photoreceptor body 31 by switching between the developing devices 34 and are then transferred to a recording medium by a transfer device (not shown).

In this exemplary embodiment, each developing device 34 has approximately the same configuration as in the first exemplary embodiment. For example, the supply of developer to the development position is shut out by stopping the rotational driving of the layer regulating member (rotary trimmer) 44.

FIG. 12A shows a non-developing state that the driving of the developing devices 34 around the photoreceptor body 31 is stopped.

Figure 12B:
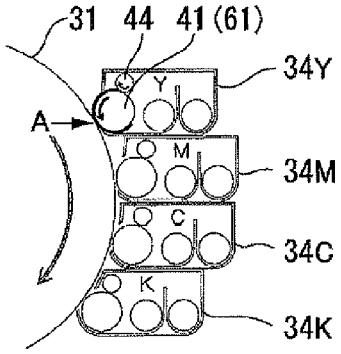
Figure 12C:
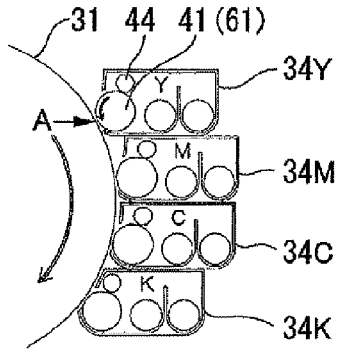

To perform a full-color-mode development operation starting from the state of FIG. 12A, as shown in FIGS. 12B and 12C, the layer regulating member (rotary trimmer) 44 is rotated in a state that the developing roll 41 (developing sleeve 61) of the Y-color developing device 34Y is being rotated, whereby Y-color developer is supplied to the development position A. When the Y-color development has completed, the rotational driving of the layer regulating member (rotary trimmer) 44 is stopped with the developing roll 41 (developing sleeve 61) kept rotating, whereby the supply of developer to the development position A is shut out.

Figure 12D:
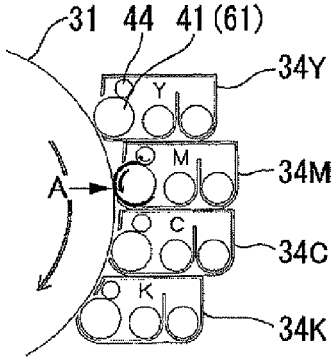
Figure 12E:
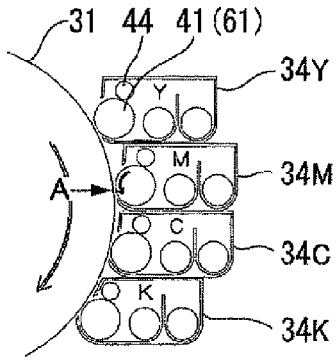

Then, as shown in FIGS. 12D and 12E, the layer regulating member (rotary trimmer) 44 is rotated in a state that the developing roll 41 (developing sleeve 61) of the M-color developing device 34M is being rotated, whereby M-color developer is supplied to the development position A. When the M-color development has completed, the rotational driving of the layer regulating member (rotary trimmer) 44 is stopped with the developing roll 41 (developing sleeve 61) kept rotating, whereby the supply of developer to the development position A is shut out.

Figure 13A:
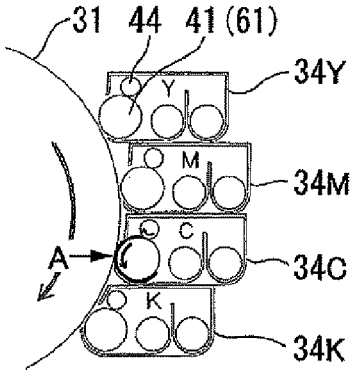
FIGS. 13A, 13B, 13C and 13D are a second set of diagrams showing how the developing devices of the respective color components operate in the image forming apparatus according to the second exemplary embodiment.
Figure 13B:
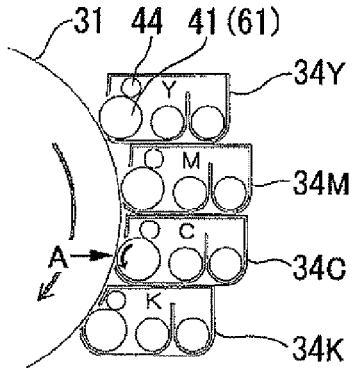

Then, as shown in FIGS. 13A and 13B, the layer regulating member (rotary trimmer) 44 is rotated in a state that the developing roll 41 (developing sleeve 61) of the C-color developing device 34C is being rotated, whereby C-color developer is supplied to the development position A. When the C-color development has completed, the rotational driving of the layer regulating member (rotary trimmer) 44 is stopped with the developing roll 41 (developing sleeve 61) kept rotating, whereby the supply of developer to the development position A is shut out.

Figure 13C:
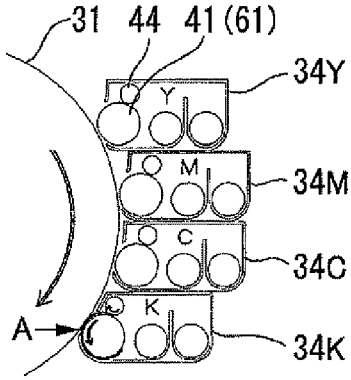
Figure 13D:
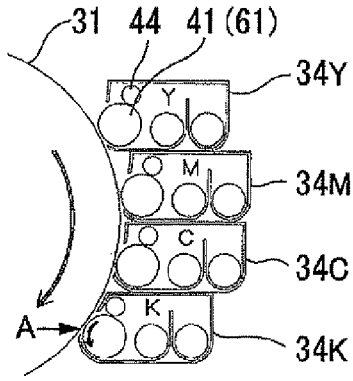

Finally, as shown in FIGS. 13C and 13D, the layer regulating member (rotary trimmer) 44 is rotated in a state that the developing roll 41 (developing sleeve 61) of the K-color developing device 34K is being rotated, whereby K-color developer is supplied to the development position A. When the K-color development has completed, the rotational driving of the layer regulating member (rotary trimmer) 44 is stopped with the developing roll 41 (developing sleeve 61) kept rotating, whereby the supply of developer to the development position A is shut out.

As described above, in this exemplary embodiment, a state that no developer exits at the development position A between the photoreceptor body 31 and the developing roll 41 is maintained while the developing device is in a non-developing state. This prevents a phenomenon that the developing device in a non-developing state deteriorates toner images of respective color components that are already formed on the photoreceptor body 31.

Exemplary Embodiment 3

Figure 14A:
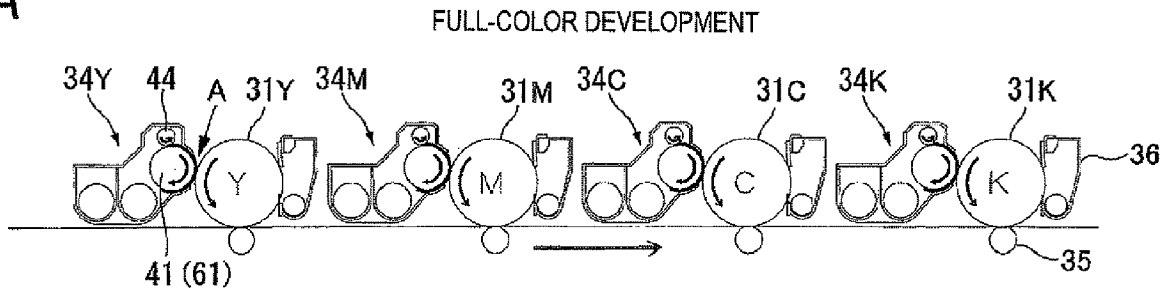

FIG. 14A shows an image forming apparatus according to a third exemplary embodiment. In this image forming apparatus, plural photoreceptor bodies 31 (31T, 31M, 31C, and 31K) are provided and plural developing devices 34 (34Y, 34M, 34C, and 34K) which use toners of respective color components are provided for the respective photoreceptor bodies 31. Toner images of the respective color components are formed on the respective photoreceptor bodies 31 and then transferred to a recording medium 38 directly or via an intermediate transfer body (not shown).

In this exemplary embodiment, an image formation control device (not shown) is provided with an element for switching between a full-color-mode image forming process and a monochrome (black)-mode image forming process.

When a full-color-mode image forming operation is to be performed, as shown in FIG. 14A, the developing device of every color component is rendered in a developing state. That is, the layer regulating member (rotary trimmer) 44 is rotated in a state that the developing roll 41 (developing sleeve 61) is being rotated, whereby developer is supplied to the development position A.

Figure 14B:
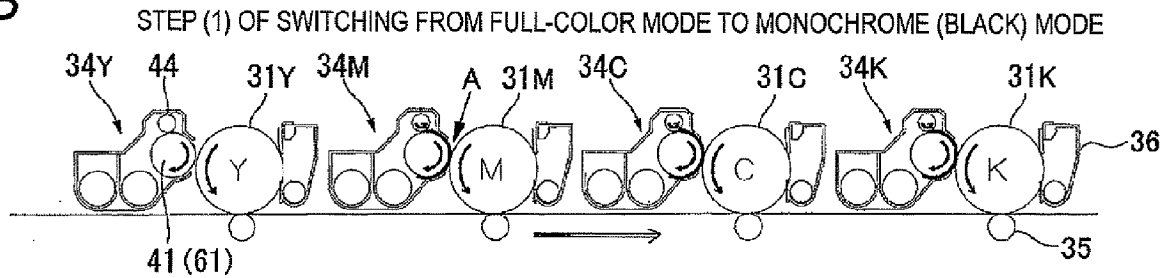
Figure 14C:
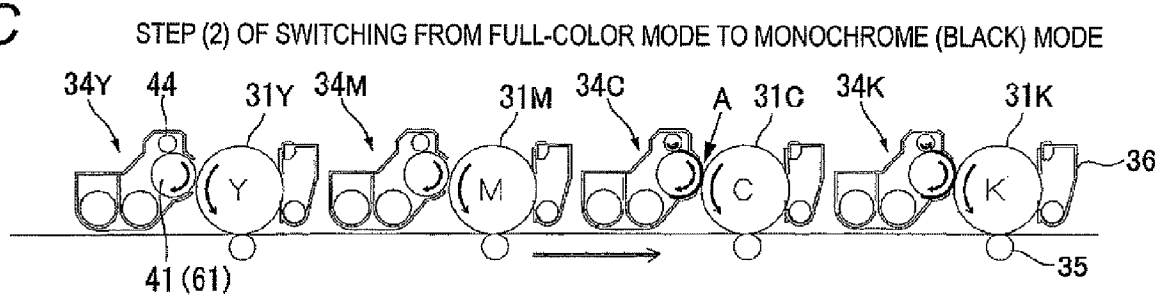
Figure 15A:
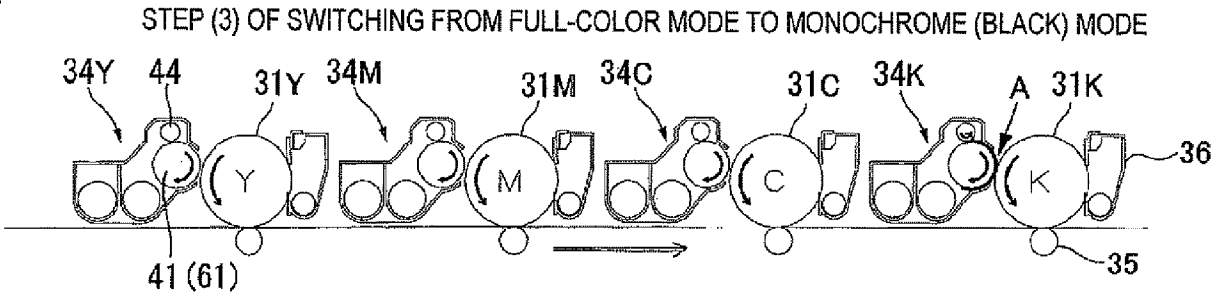
FIGS. 15A, 15B and 15C are a second set of diagrams showing how the developing devices of the respective color components operate when switching is made from the full-color mode to the monochrome (black) mode in the image forming apparatus according to the third exemplary embodiment.
Figure 15B:
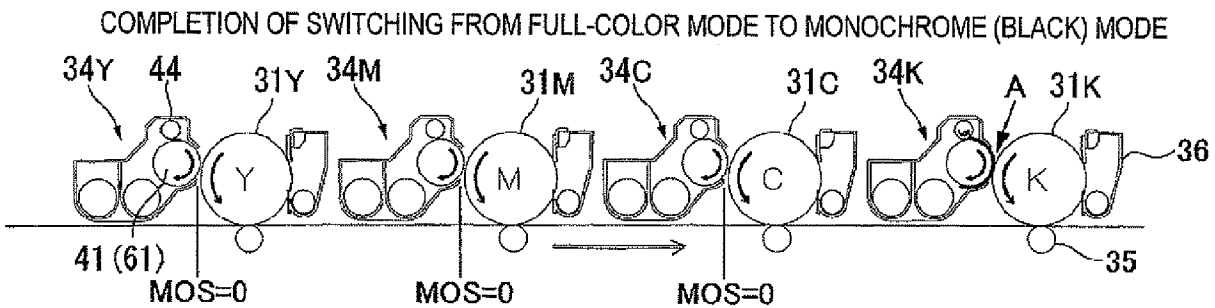
Figure 15C:
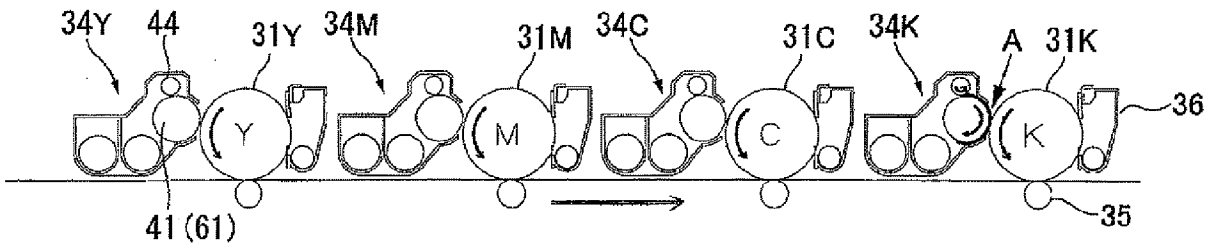

To switch from the full-color mode to the monochrome (black) mode, as shown in FIGS. 14B, 14C, and 15A, the rotational driving of the layer regulating member (rotary trimmer) 44 is stopped with the developing roll 41 (developing sleeve 61) kept rotating in the Y-color developing device 34Y, the M-color developing device 34, and the C-color developing device 34C in this order. As a result, as shown in FIG. 15B, in each of the developing devices 34 (34Y, 34M, and 34C) to be rendered in a non-developing state, the supply of developer to the development position A is shut out and the developer conveyance rate is made zero. In this state, as shown in FIG. 150, the rotational driving of the developing roll 41 (developing sleeve 61) is stopped in each of the developing devices 34 (34Y, 34M, and 34C) which are in the non-developing state.

In this exemplary embodiment, no developer exits at the development position A when the rotational driving of the developing roll 41 (developing sleeve 61) is stopped in each of the developing devices 34 (34Y, 34M, and 340) to be rendered in a non-developing state. Therefore, even if the developing roll 41 (developing sleeve 61) is stopped suddenly, the probability that developer comes off the developing roll 41 is very low.

Exemplary Embodiment 4

Figure 16A:
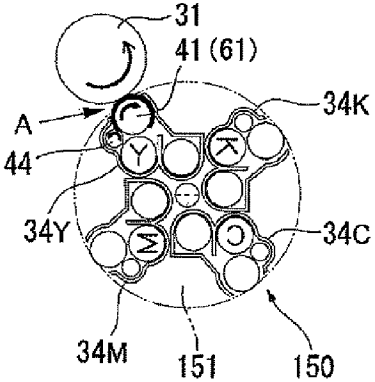
FIGS. 16A, 16B, 16C, 16D, 16E and 16F are a first set of diagrams showing how developing devices of respective color components provided in a rotary developing unit operate in a full-color mode in an image forming apparatus according to a fourth exemplary embodiment which is provided with the rotary developing unit.

FIG. 16A shows an image forming apparatus according to a fourth exemplary embodiment. In this image forming apparatus, a rotary developing unit 150 is disposed adjacent to a single photoreceptor body 31.

The rotary developing unit 150 has a rotary support frame 151 which is rotatable, and the rotary support frame 151 is mounted with plural developing devices 34 (34Y, 34M, 34C, and 34K) which use toners of respective color components. As the photoreceptor body 31 is rotated plural times, the developing device 34 that is opposed to the photoreceptor body 31 at the development position A is selected from the developing devices 34Y, 34M, 340, and 34K by rotating the rotary support frame 151 intermittently. In this manner, toner images of the respective color components are sequentially formed on the photoreceptor body 31 and then transferred to a recording medium directly or via an intermediate transfer body.

Figure 16B:
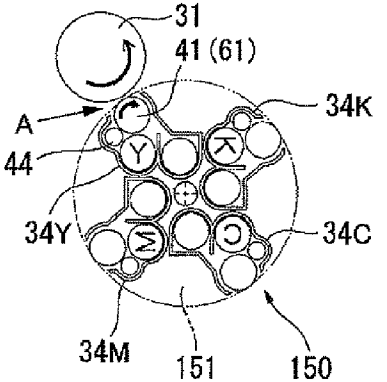
Figure 16C:
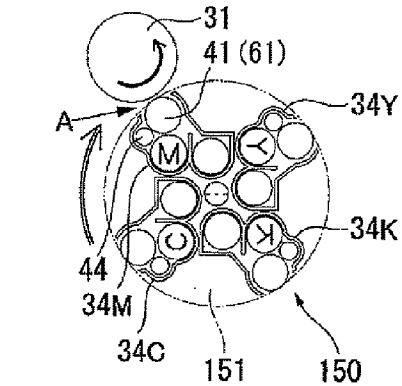

In this exemplary embodiment, a full-color-mode developing operation is performed in the following manner. First, as shown in FIGS. 16A and 16B, the Y-color developing device 34Y is placed at the development position A and a Y-color developing operation is performed by rotationally driving the developing roll 41 (developing sleeve 61) and the layer regulating member (rotary trimmer) 44. After completion of the Y-color developing operation, the rotational driving of the layer regulating member (rotary trimmer) 44 is stopped with the developing roll 41 (developing sleeve 61) kept rotating, whereby the supply of developer to the development position A is shut out. Then, as shown in FIG. 16C, the M-color developing device 34Y is placed at the development position A by rotating the rotary support frame 151.

Figure 16D:
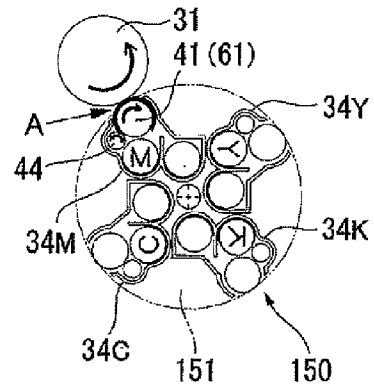
Figure 16E:
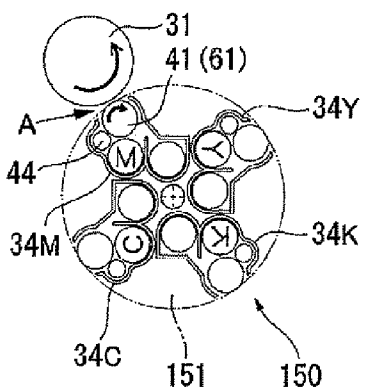
Figure 16F:
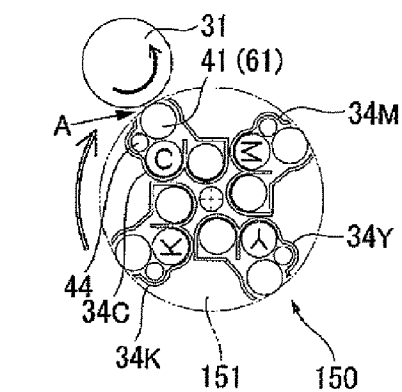

Then, as shown in FIGS. 16D and 16E, an M-color developing operation is performed by and rotationally driving the developing roll 41 (developing sleeve 61) and the layer regulating member (rotary trimmer) 44 of the M-color developing device 34Y. After completion of the M-color developing operation, the rotational driving of the layer regulating member (rotary trimmer) 44 is stopped with the developing roll 41 (developing sleeve 61) kept rotating, whereby the supply of developer to the development position A is shut out. Then, as shown in FIG. 16F, the C-color developing device 34C is placed at the development position A by rotating the rotary support frame 151.

Figure 17A:
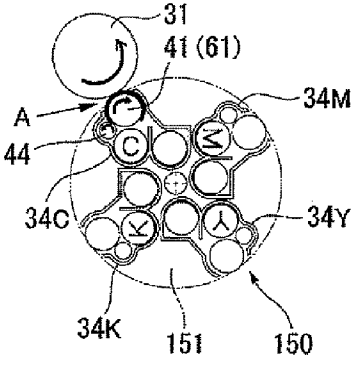
FIGS. 17A, 17B, 17C, 17D, 17E and 17F are a second set of diagrams showing how the developing devices of the respective color components provided in the rotary developing unit operate in the full-color mode in the image forming apparatus according to the fourth exemplary embodiment.
Figure 17B:
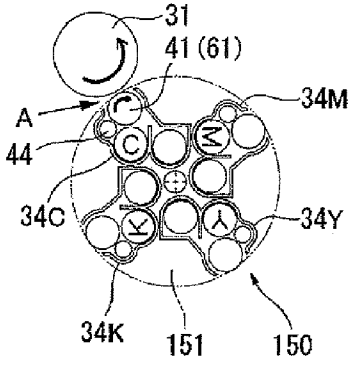
Figure 17C:
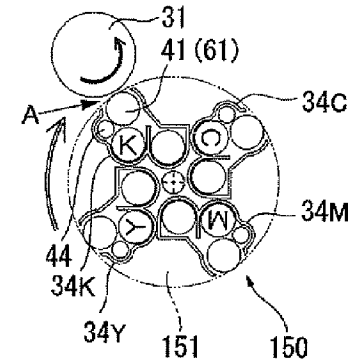

Then, as shown in FIGS. 17A and 17B, a C-color developing operation is performed by and rotationally driving the developing roll 41 (developing sleeve 61) and the layer regulating member (rotary trimmer) 44 of the C-color developing device 34C. After completion of the C-color developing operation, the rotational driving of the layer regulating member (rotary trimmer) 44 is stopped with the developing roll 41 (developing sleeve 61) kept rotating, whereby the supply of developer to the development position A is shut out. Then, as shown in FIG. 17C, the K-color developing device 34K is placed at the development position A by rotating the rotary support frame 151.

Figure 17D:
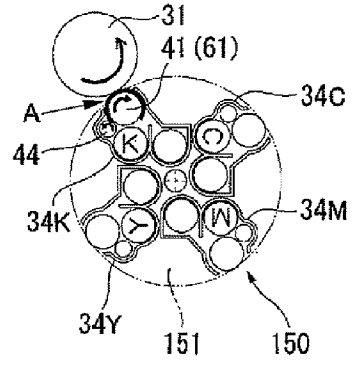
Figure 17E:
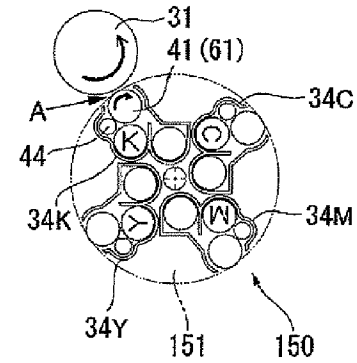
Figure 17F:
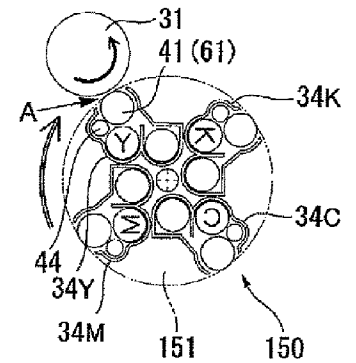

Then, as shown in FIGS. 17D and 17E, a K-color developing operation is performed by and rotationally driving the developing roll 41 (developing sleeve 61) and the layer regulating member (rotary trimmer) 44 of the K-color developing device 34K. After completion of the K-color developing operation, the rotational driving of the layer regulating member (rotary trimmer) 44 is stopped with the developing roll 41 (developing sleeve 61) kept rotating, whereby the supply of developer to the development position A is shut out. Then, as shown in FIG. 17F, the Y-color developing device 34Y is placed at the development position A by rotating the rotary support frame 151.

As described above, in this exemplary embodiment, the developing device of the next color component is moved to the development position A after a developing operation has completed and the supply of developer to the development position A has been shut out in each developing device 34 (34Y, 34M, 34C, or 34K) of the rotary developing unit 150. Therefore, the probability that developer comes off the developing device 34 used immediately before when switching is made to the next one.

EXAMPLES

Figure 18A:
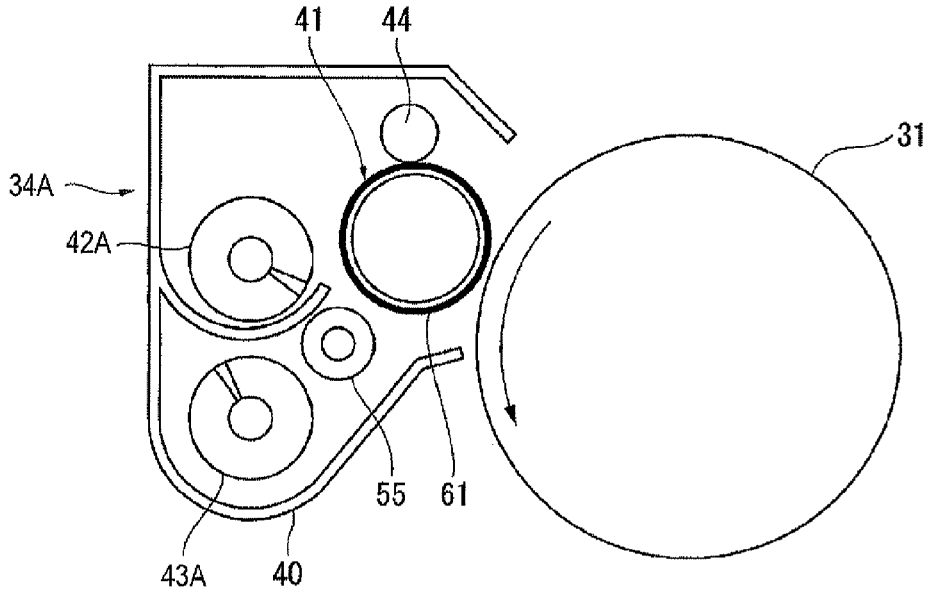
FIG. 18A illustrates a developing device according to Example.

An image forming apparatus according to Example is the same in configuration as the image forming apparatus according to the first exemplary embodiment except that as shown in FIG. 18A stirring and transporting members 42A and 43A are arranged in the vertical direction and a roll 55 for collecting unused developer that is held by the developing roll 41 is added in a developing device 34A. The developing roll 41 (having the smooth sleeve 61) and the layer regulating member (rotary trimmer) 44 are the same as in the first exemplary embodiment.

Figure 18B:
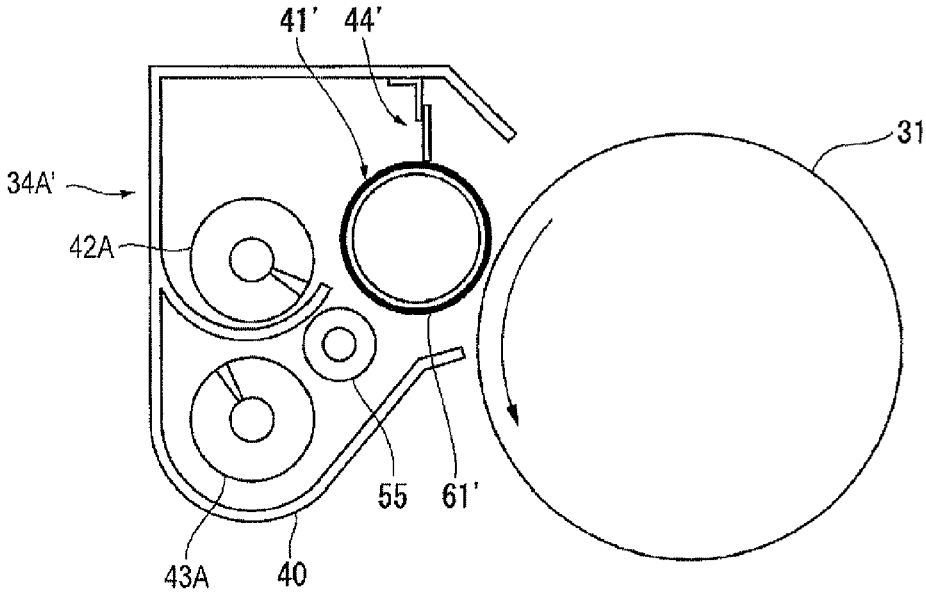
FIG. 18B illustrates developing devices according to Comparative Examples 1 and 2.

Image forming apparatus according to Comparative Examples which are shown in FIG. 18B are the same as the image forming apparatus according to Example except that a developing sleeve 61' of a developing roll 41' is a blasted sleeve or a grooved sleeve and a layer regulating member 44' is a plate-like regulating member (fixed trimmer) which is a magnetic plate.

Figure 19A:
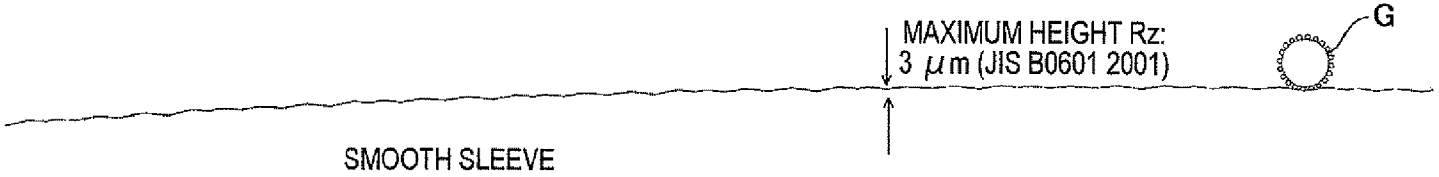
FIG. 19A illustrates a surface state of a developing sleeve (smooth sleeve) used in Example.

The developing sleeve 61 used in Example is a smooth sleeve shown in FIG. 19A whose smooth surface has surface roughness of 3 μm in terms of maximum height Rz.

Figure 19B:
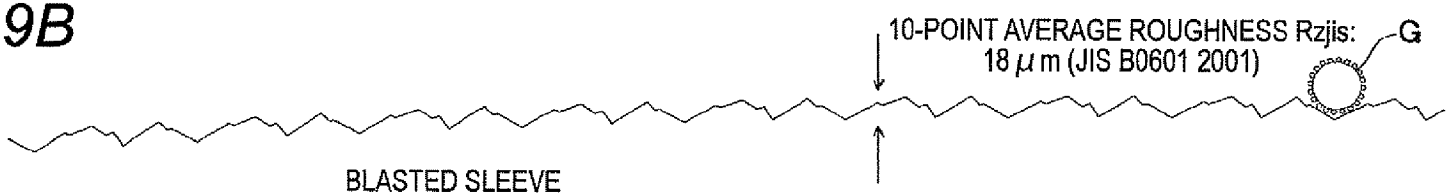
FIG. 19B illustrates a surface state of a developing sleeve (blasted sleeve) used in Comparative Example 1.
Figure 19C:
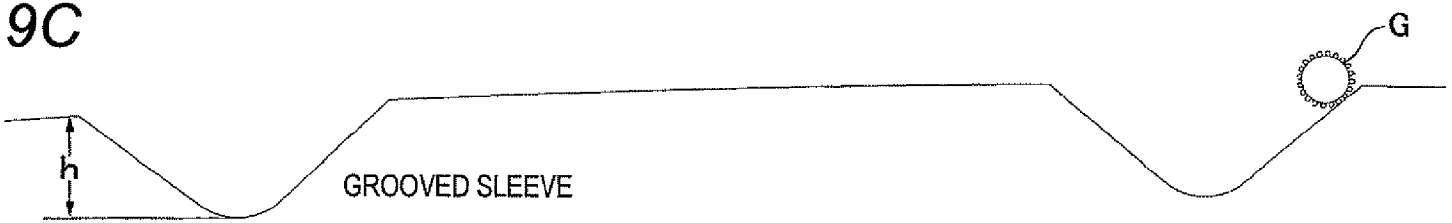
FIG. 19C illustrates a surface state of a developing sleeve (grooved sleeve) used in Comparative Example 2.

On the other hand, in Comparative Examples 1 and 2, the developing sleeve 61' is a blasted sleeve shown in FIG. 19B (produced by performing blast processing on the smooth sleeve 61 used in Example) or a grooved sleeve shown in FIG. 19C (produced by performing groove formation processing on the smooth sleeve 61 used in Example).

In each of Example and Comparative Examples, the interval between the layer regulating member and the developing sleeve is set at 240 μm.

To evaluate performance of each of the developing device 34A according to Example and the developing devices 34A' according to Comparative Examples, developer conveyance rates (MOS values) are measured for various combinations of a layer regulating member (trimmer), a magnetic flux density of a layer regulating magnetic pole, and a developing sleeve surface type. Results are shown in FIG. 20.

As seen from FIG. 20, in Comparative Examples 1 and 2, the combinations of the fixed trimmer and the blasted sleeve or the groove sleeve are suitable to obtain a constant developer conveyance rate but they have difficulty adjusting the developer conveyance rate.

In contrast, in Example, it is confirmed that the combination of the rotary trimmer and the smooth sleeve makes it possible to adjust the developer conveyance rate very easily.

It is understood that layer formation itself is impossible in the case of the combination of the smooth sleeve and the fixed trimmer.

In Example, the developer conveyance rate is appropriate (not too high) when the magnetic flux density of the layer regulating magnetic pole at the layer regulating position is 50 mT. However, when the magnetic flux density of the layer regulating magnetic pole is 80 mT, the developer conveyance rate is high though the developing device is usable. A preferable range of the magnetic flux density of the layer regulating magnetic pole at the layer regulating position is 30 to 60 mT; in this range, the developer conveyance rate can be adjusted to a proper value.

Furthermore, developer conveyance rates (MOS values) are measured for Example 1 (corresponds to the above "Example") and Example 2 in which the interval between the layer regulating member and the developing sleeve is set at 240 μm and 70 μm, respectively, and Comparative Example 3 in which the rotary trimmer and the blasted sleeve are used in combination.

Figure 21:
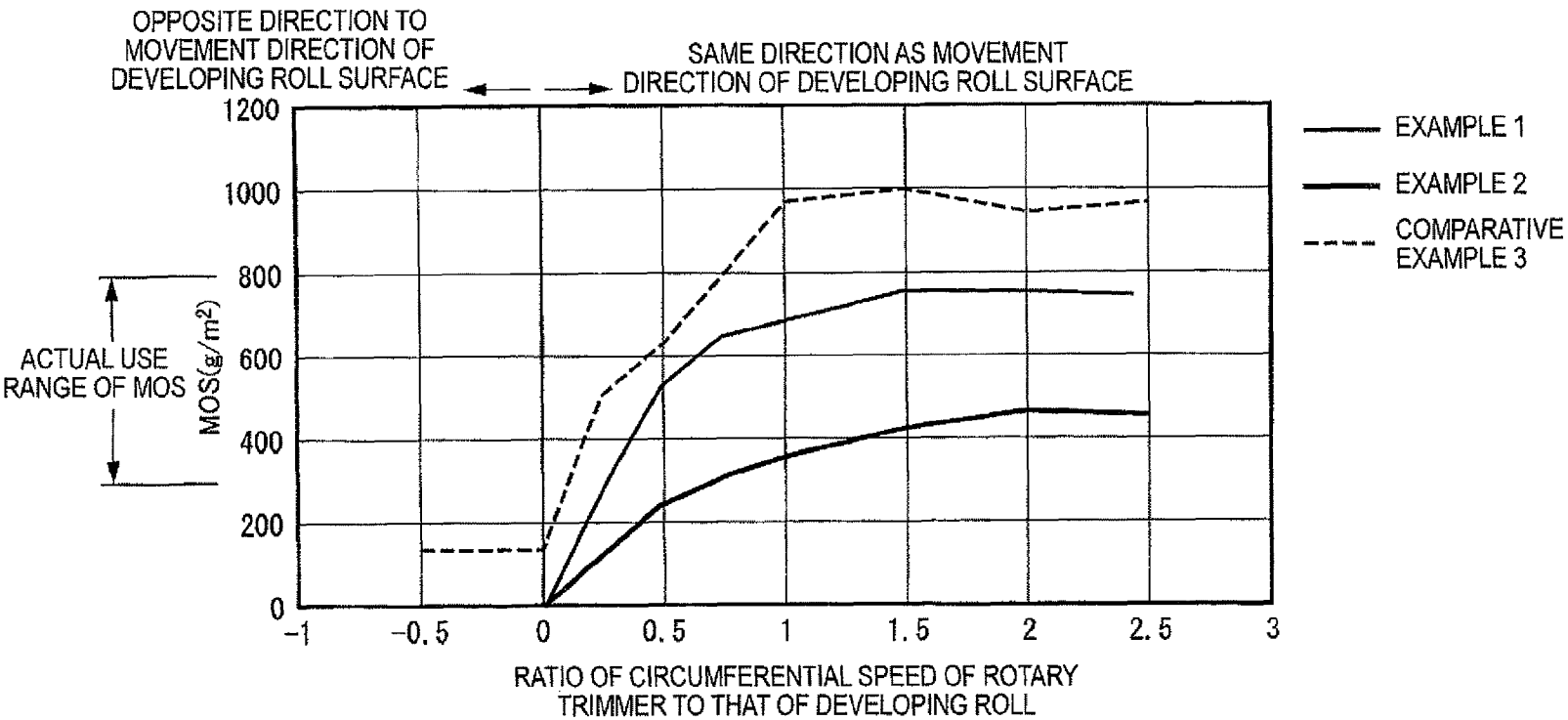
FIG. 21 is a graph showing relationships between the circumferential speed ratio of the rotary trimmer and the developer conveyance rate in the developing devices according to Examples 1 and 2 and Comparative Example 3.

FIG. 21 shows results of the relationship between the rotary trimmer circumferential speed ratio and the developer conveyance rate obtained for Examples 1 and 2 and Comparative Example 3.

It is seen that in each of Examples 1 and 2 the developer conveyance rate can be adjusted in its actual use range of 300 to 800 g/m$^2$. In contrast, in Comparative Example 3, the developer conveyance rate exceeds its actual use range when the rotary trimmer circumferential speed ratio is larger than 0.7.

In Examples 1 and 2 the surface roughness of the smooth surface of the developing sleeve is 3 μm in terms of maximum height. Similar experiments are conducted in which the surface roughness of the smooth surface is varied and results are similar to those obtained for Examples 1 and 2 as long as the surface roughness of the smooth surface is lower than or equal to 5 μm in terms of maximum height.

Similar experiments are conducted in which the interval between the layer regulating member and the developing sleeve is varied in its actual use range of 0.035 to 1.5 mm and results are similar to those obtained for Examples 1 and 2. In particular, it is found that the performance is stable in an approximate range of 0.060 to 1.0 mm.

The foregoing description of the embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention defined by the following claims and their equivalents.

What is claimed is:

1. A developing device comprising:

a developer holding body comprising:

a hollow development rotary body which is opposed to an image holding body capable of holding a toner image and has a smooth surface whose surface roughness is lower than or equal to 5 μm in terms of maximum height; and a magnet member which is fixedly housed in the development rotary body and in which a plurality of magnetic poles are arranged alongside its periphery, the developer holding body operating in such a manner that developer containing toner and carrier is held on the development rotary body by magnetic force produced by the magnetic poles of the magnet member as the development rotary body is rotated, wherein the magnetic member of the developer holding body comprises a layer regulating magnetic pole which produces a magnetic flux density of 30 to 60 mT in a region where a layer regulating rotary body and the development rotary body are closest to each other;

said layer regulating rotary body which is opposed to the development rotary body with a non-contact gap formed between them so as to regulate the thickness of a developer layer held on the developer holding body, a first portion, facing the development rotary body, of the layer regulating rotary body being able to move in the same direction as a second portion of the development rotary body, the second portion facing the first portion;

the layer regulating rotary body rotating in a direction opposite to a direction of rotation of the development rotary body; and a development driving device for rotationally driving the development rotary body of the developer holding body and the layer regulating rotary body and variably adjusting the circumferential speed of the layer regulating rotary body according to an increase or decrease in the thickness, to be regulated, of a developer layer held on the developer holding body, during a development operation.

2. The developing device according to claim 1, wherein the magnetic member of the developer holding body comprises a layer restricting magnetic pole which is disposed so that a position of its peak magnetic flux density is located upstream of a region where layer regulating rotary body and the development rotary body are closest to each other in a developer conveying direction.

3. The developing device according to claim 1, wherein the layer regulating rotary body has a smooth surface whose surface roughness is lower than or equal to 5 μm in terms of maximum height.

4. The developing device according to claim 1, wherein a gap of 60 μm to 1 mm is formed between the layer regulating rotary body and the development rotary body.

5. The developing device according to claim 1, wherein whereas the development driving device rotationally drives the development rotary body, and stops rotational driving of the layer regulating rotary body or rotationally drives the layer regulating rotary body in such a manner that a portion, facing the development rotary body, of the layer regulating rotary body is moved in a direction opposite to a movement direction of a corresponding portion of the development rotary body, whereby a conveyance rate of developer held on the developer holding body that has passed the layer regulating rotary body and is moving toward a development position between the image holding body and the developer holding body is made approximately equal to zero.

6. An image forming apparatus comprising:

an image holding body capable of holding a toner image;

a latent image forming device for forming an electrostatic latent image on the image holding body; and the developing device according to claim 1 for developing, with toner, the electrostatic latent image formed on the image holding body.

7. The image forming apparatus according to claim 6, further comprising a calculating section for calculating a conveyance rate of developer to be used for development according to a use condition of the image forming apparatus, and a circumferential speed determining section for determining a circumferential speed of the layer regulating rotary body so as to obtain the calculated developer conveyance rate.

8. An image forming apparatus comprising:

an image holding body capable of holding toner images of respective color components;

a latent image forming device for forming electrostatic latent images of the respective color components on the image holding body; and a plurality of the developing devices according to claim 5 provided around the image holding body, for developing, sequentially, with respective color toners, the electrostatic latent images of the respective color components formed on the image holding body, wherein:

in a developing device that is in a non-operating state, the development driving device shuts out supply of developer to the development position between the image holding body and the developer holding body by stopping rotational driving of the layer regulating rotary body or rotationally driving the layer regulating rotary body in such a manner that a portion, facing the development rotary body, of the layer regulating rotary body is moved in a direction opposite to a movement direction of a corresponding portion of the development rotary body while rotationally driving the development rotary body, and then stops the rotational driving of the development rotary body.

9. An image forming apparatus comprising:

a plurality of image holding bodies capable of holding toner images of color components, respectively;

a latent image forming device for forming electrostatic latent images of the color components on the image holding bodies, respectively;

a plurality of the developing devices according to claim 5 provided for the respective image holding bodies, for developing, with color toners, the electrostatic latent images of the color components formed on the image holding bodies, respectively; and an image formation control device for switching between a multi-color image formation control process for formation of a multi-color image and a monochrome image formation control process for formation of a monochrome image, wherein:

when the image formation control device switches from the multi-color image formation control process to the monochrome image formation control process, in a developing device that is in a non-operating state, the development driving device shuts out supply of developer to the development position between the image holding body and the developer holding body by stopping rotational driving of the layer regulating rotary body or rotationally driving the layer regulating rotary body in such a manner that a portion, facing the development rotary body, of the layer regulating rotary body is moved in a direction opposite to a movement direction of a corresponding portion of the development rotary body while rotationally driving the development rotary body, and then stops the rotational driving of the development rotary body.

10. An image forming apparatus comprising:

an image holding body capable of holding toner images of respective color components;

a latent image forming device for forming electrostatic latent images of the respective color components on the image holding body; and a rotary developing assembly in which a plurality of the developing devices according to claim 5 for developing, with respective color toners, the electrostatic latent images of the respective color components formed on the image holding body are supported rotatably by a rotary support body and which is rotated so that a developing device to be opposed to the image holding body at the development position is selected, wherein:

when a developing operation is finished in each developing device of the rotary developing assembly, the development driving device shuts out supply of developer to the development position between the image holding body and the developer holding body by stopping rotational driving of the layer regulating rotary body or rotationally driving the layer regulating rotary body in such a manner that a portion, facing the development rotary body, of the layer regulating rotary body is moved in a direction opposite to a movement direction of a corresponding portion of the development rotary body while rotationally driving the development rotary body, then stops the rotational driving of the development rotary body, and then causes rotation of the rotary developing assembly so that a developing device of the next color component is selected.

* * * * *